US007051627B2

(12) United States Patent
Rivera

(10) Patent No.: US 7,051,627 B2
(45) Date of Patent: May 30, 2006

(54) FOLDING MULTIPURPOSE TOOL INCLUDING BLADE LOCK RELEASE MECHANISM

(75) Inventor: Benjamin C. Rivera, West Linn, OR (US)

(73) Assignee: Leatherman Tool Group, Inc., Portland, OR (US)

( * ) Notice: Subject to any disclaimer, the term of this patent is extended or adjusted under 35 U.S.C. 154(b) by 0 days.

(21) Appl. No.: 10/267,707

(22) Filed: Oct. 8, 2002

(65) Prior Publication Data

US 2003/0037644 A1 Feb. 27, 2003

Related U.S. Application Data

(63) Continuation of application No. 09/479,411, filed on Jan. 12, 2000, now Pat. No. 6,510,767.

(51) Int. Cl.
*B25B 23/00* (2006.01)

(52) U.S. Cl. ..... 81/440; 81/427.5; 7/128

(58) Field of Classification Search ..... 7/127–136; 81/440, 427.5, 427; 30/151–155, 252–255
See application file for complete search history.

(56) References Cited

U.S. PATENT DOCUMENTS

| | | | | |
|---|---|---|---|---|
| 237,138 | A | 2/1881 | Slayton | |
| 542,601 | A | 7/1895 | Baker | |
| 673,153 | A | 4/1901 | Baseler | |
| 924,796 | A | 6/1909 | Klever | |
| 947,823 | A | 2/1910 | Kinney | |
| 1,362,143 | A | 12/1920 | Rohrer | |
| 1,370,906 | A | 3/1921 | Newton | |
| 1,635,649 | A | 7/1927 | Tillmanns | |
| 2,391,732 | A | 12/1945 | Mirando | 30/22 |
| 2,392,118 | A | 1/1946 | Cacarillo | 30/261 |
| 2,561,682 | A | 7/1951 | Barnett | 81/84 |
| 2,952,912 | A | 9/1960 | Crawford | 30/255 |

(Continued)

FOREIGN PATENT DOCUMENTS

EP 0 714 736 A1 6/1996

(Continued)

OTHER PUBLICATIONS

SOG, PowerLock folding tool model S-60, on sale at least as early as May 1999, instruction sheet and photographs.

(Continued)

*Primary Examiner*—Hadi Shakeri
(74) *Attorney, Agent, or Firm*—Chernoff, Vilhauer, McClung & Stenzel, LLP

(57) ABSTRACT

A folding multipurpose tool incorporating a latch release mechanism including a lever, a cam, and a rocker-shaped grip body to easily effect release of a catch for holding knife or screwdriver blades extended. spring and cams are arranged to hold a pair of handles either extended or folded with respect to the tangs of a pair of pliers jaws or the like. The handles include inwardly directed comfortable rounded rims. Portions of folding blades interlock with other folding blades on an opposite handle when the tool is folded, to stabilize the handles while using a knife or screwdriver. Blades of folding scissors include edges that are serrated only near their tips. A container opener includes a hook defining a recessed throat.

8 Claims, 24 Drawing Sheets

U.S. PATENT DOCUMENTS

| | | | | | |
|---|---|---|---|---|---|
| 3,825,961 | A | | 7/1974 | Klein | 7/1 H |
| 4,124,939 | A | | 11/1978 | Onoue | 30/161 |
| 4,203,208 | A | | 5/1980 | Tausendfreundt et al. | 30/155 |
| 4,238,862 | A | | 12/1980 | Leatherman | 7/128 |
| 4,744,272 | A | | 5/1988 | Leatherman | 81/427.5 |
| 4,888,869 | A | | 12/1989 | Leatherman | 30/161 |
| 5,168,629 | A | | 12/1992 | Willard | 30/231 |
| 5,267,366 | A | | 12/1993 | Frazer | 7/128 |
| 5,280,659 | A | | 1/1994 | Park | 7/128 |
| 5,320,004 | A | * | 6/1994 | Hsiao | 81/440 |
| 5,491,856 | A | * | 2/1996 | Legg | 7/128 |
| D368,634 | S | * | 4/1996 | Frazer | D8/105 |
| 5,689,886 | A | * | 11/1997 | Yeh | 20/162 |
| 5,697,114 | A | | 12/1997 | McIntosh et al. | 7/129 |
| 5,745,997 | A | | 5/1998 | Berg et al. | 30/155 |
| 5,765,247 | A | | 6/1998 | Seber et al. | 7/128 |
| 5,781,950 | A | | 7/1998 | Swinden et al. | 7/128 |
| 5,791,002 | A | | 8/1998 | Gardiner et al. | 7/128 |
| 5,946,752 | A | | 9/1999 | Parrish | 7/118 |
| 5,978,993 | A | * | 11/1999 | Rivera | 7/128 |
| 5,979,059 | A | | 11/1999 | Leatherman et al. | 30/161 |
| 6,006,385 | A | | 12/1999 | Kershaw et al. | 7/129 |
| 6,014,787 | A | | 1/2000 | Rivera | 7/128 |
| 6,065,213 | A | | 5/2000 | Rivera | 30/155 |
| 6,098,225 | A | | 8/2000 | McIntosh et al. | 7/158 |
| 6,389,625 | B1 | | 5/2002 | Rivera | |
| 6,510,767 | B1 | | 1/2003 | Rivera | |
| 6,763,543 | B1 | | 7/2004 | Rivera | |
| 2004/0237207 | A1 | | 12/2004 | Rivera | |

FOREIGN PATENT DOCUMENTS

| | | | |
|---|---|---|---|
| EP | 0 771 622 | A1 | 7/1997 |
| EP | 0 783 937 | A2 | 7/1997 |
| EP | 0 854 014 | A1 | 7/1998 |
| EP | 1 023 972 | A3 | 11/2000 |
| WO | WO 98/18599 | | 5/1998 |

OTHER PUBLICATIONS

R.C.E. "Magnum" fish gripper, on sale at least as early as 1990, package and photographs.

Kershaw, small pocket knife with folding scissors, on sale prior to Jan. 1999, photographs.

Buck Knives, Bucklite multipurpose folding tool, model 355, on sale prior to May 1999, photographs.

Folding scissors marked INOX France, on sale at least as early as 1994, photographs.

Folding scissors with chain, on sale at least as early as 1994,photographs.

Gerger, multipurpose folding tool model MPT 5, on sale at least as early as 1998, photographs.

Additional photographs, labeled A-C, of Gerber multi-function tool model MPT 5 available at least as early as 1998.

* cited by examiner

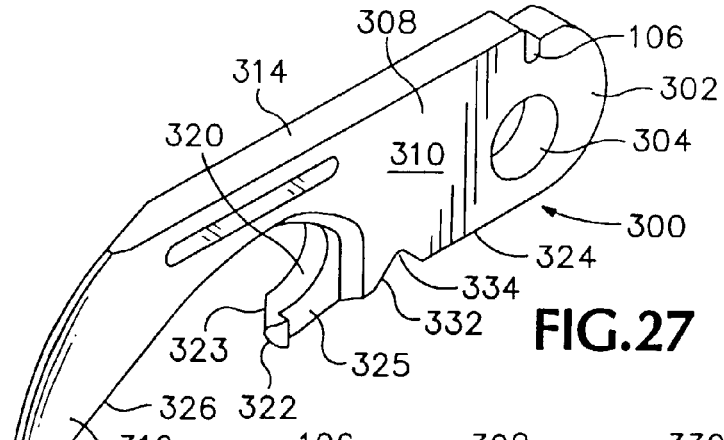
FIG.27
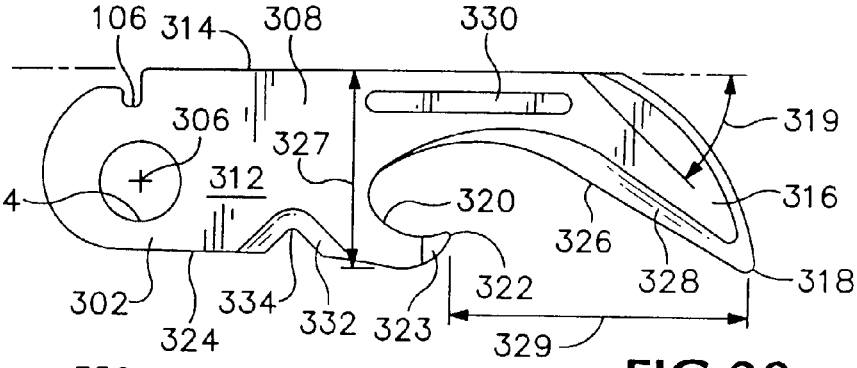
FIG.28
FIG.29
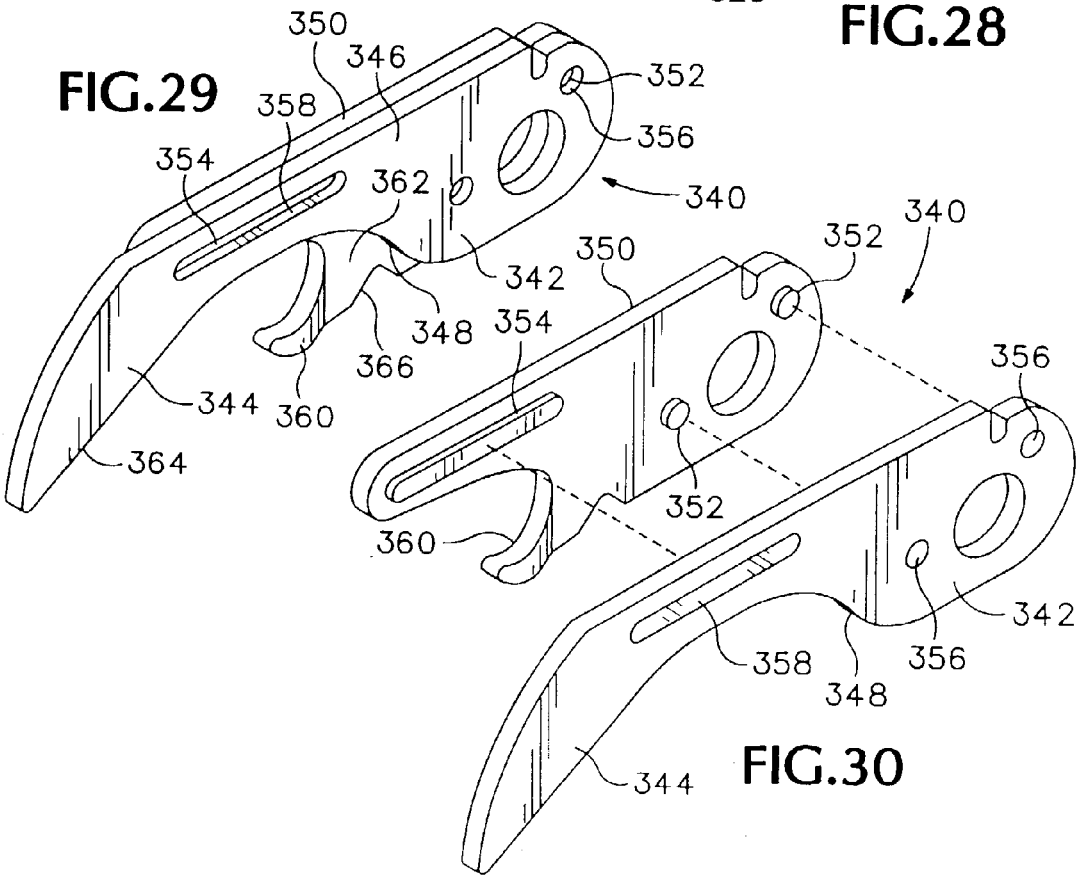
FIG.30

FOLDING MULTIPURPOSE TOOL INCLUDING BLADE LOCK RELEASE MECHANISM

RELATED APPLICATIONS

This application is a continuation of U.S. patent application Ser. No. 09/479,411, filed Jan. 12, 2000, now U.S. Pat. No. 6,510,767.

BACKGROUND OF THE INVENTION

The present invention relates to a multipurpose folding tool, and particularly to such a tool including folding scissors, a blade latch release mechanism, and handles that provide comfort during use of pliers incorporated in such a tool.

As shown in Leatherman U.S. Pat. No. 4,238,862, Rivera U.S. Pat. No. 5,743,582 and Berg, et al., U.S. Pat. No. 5,745,997, multipurpose folding tools are well known and may contain folding pliers, various folding tool bits such as screwdrivers, files, and knife blades, and folding scissors that can be stored in cavities defined within handles configured as generally U-shaped channels. Tools of this type may include latches that hold a selected one of various screwdrivers or blades in an extended, operational position with respect to one of the handles, as shown in U.S. Pat. No. 5,979,059. Such tools may incorporate numerous types of handles, folding and latching arrangements, and folding scissors.

As useful as such folding multipurpose tools are, they still leave improvement desirable in certain details of their construction and operation. In particular, releasing certain latch mechanisms that hold selected blades in an extended position may require another blade or tool to be opened, or may entail use of a latch release lever that is located within a tool handle, occupying space that would better be occupied by a useful tool bit or blade. Accordingly, an improved latch release mechanism is desired. Preferably, such a latch release mechanism should be able to be operated easily, without the tool having to be held in a particular way in order to release a latched blade.

While functional blade latch mechanisms have previously been known in folding tools whose handles are of sheet metal construction, greater security for keeping a selected blade latch in an extended position is desired.

Most folding multipurpose tools having handles in the form of U-shaped channels have the open sides of the channels facing outwardly away from each other when the handles are unfolded to use a pair of pliers or similar tool jaws, in order to be able to receive the tool jaws within the channels when such a tool is folded. The channel sides, however, often have narrow edges that make use of such pliers uncomfortable. It is therefore desired to provide comfortable surfaces to be gripped when a multipurpose tool with handles in the form of channels is unfolded to permit use of the incorporated pliers or similar tools.

Construction of a folding multipurpose tool has previously required costly adherence to close manufacturing tolerances. Assembly of the pivot joint interconnecting a folding tool handle with a pliers jaw or the like has required adjustment by skilled personnel for the handles to be held securely in either an extended configuration or a folded condition with respect to a pair of tool jaws, yet also be folded and unfolded easily. It is therefore desired to provide a mechanism that permits smoothly folding and unfolding the handles, that operates reliably to hold the handles in a selected position with respect to such pliers jaws or the like, and that is less costly than the previously known corresponding mechanisms.

It is sometimes difficult to cut certain fibrous cords or bundles of strong fibers with scissors small enough for stowage in a folding multipurpose tool's handles. Small, tough fibers are sometimes squeezed out from between the scissors blades, and it is therefore desired to provide folding scissors that overcome that problem.

Folding multipurpose tools have previously incorporated container openers intended to remove crown caps from bottles, to pierce the tops of beverage cans, and to remove the tops from cans used to preserve foods and the like. Such previously available openers have either been undesirably large, or if small enough to fit well within the space available in a folding multipurpose tool, such openers have tended not to function well in removing the tops from cans, often leaving rough or burred edges. It is therefore desired to provide a combination opener that performs well and reliably, without leaving excessively burred edges, yet is easily and inexpensively manufactured.

In using screwdrivers included in a folding multipurpose tool twisting forces may cause the handles of previously available tools to move undesirably with respect to each other. Also, where several blades may be stowed in a handle it is often difficult to open blades located between others. Tool construction that will keep a pair of handles securely located as they should be with respect to each other during use of such screwdriver blades, and that will also facilitate opening of a folded blade is therefore desired.

What is desired, then, is an improved multipurpose folding tool including improvements in some or all of the above-mentioned areas.

BRIEF SUMMARY OF THE INVENTION

The present invention provides answers to the needs mentioned above for improvements in various aspects of a folding multipurpose tool. In particular, in accordance with one aspect of the present invention, a blade latch release mechanism includes a latch release lever located within a channel-shaped handle for a multipurpose tool, adjacent one side of the handle. The latch release lever includes a protruding part which is moved to press against a latch spring and thus remove a catch from a notch defined in the base of a folding blade or tool bit.

In one preferred embodiment of a latch release mechanism according to the present invention a latch operating lever provides a force-multiplying mechanical advantage to move a cam arranged to move a latch release lever.

In one preferred embodiment of such a latch release mechanism an arcuate grip surface is located so as to provide an increasing lever arm length at the position where a person's thumb or finger is most likely to contact the grip surface during movement of the latch release operating lever, so that the mechanical advantage available to the user increases as the mechanism moves the latch spring further, and the force required to continue to move the latch release operating lever in releasing latch increases only slightly throughout the entire length through which the latch release operating lever has to be moved.

According to another aspect of the invention, the sides of the channel-shaped handle include rims merging with an outer surface of the handle in a smoothly arcuate surface. Such rims extend inwardly within the handle, defining a space for a portion of a latch release lever.

As another principal aspect of the present invention, the rim along the margin of each sidewall of the channel-shaped handle continues without interruption from one end of the handle to an opposite blade pivot end of the handle, providing a smooth, comfortable surface to be gripped, even in the areas where the margin of the sidewall is indented to give access to blades or tool bits stowed within cavities defined by the handles.

In one embodiment of this aspect of the invention the rim extends inwardly far enough to engage the back of a blade adjacent the sidewall of the handle to keep such a blade stowed within the handle while other blades located closer to the center of the handle are raised from their stowed positions.

According to another major aspect of the invention, a spring is attached to the handle and rides on a cam surface on a tang of a pliers jaw to control pivoting motion of each handle with respect to the tangs of a pair of pliers jaws and, by camming action, to urge the handles into the fully extended position or into a folded position with respect to the pliers jaws once the handles approach such a position with respect to the tangs of the pliers jaws.

In one embodiment of this aspect of the invention, a raised portion of the tang of a pliers jaw cooperates with a lateral surface on the spring to keep the spring aligned properly with the tang.

In such an embodiment of this aspect of the invention, the spring may have a forked outer end including a pair of prongs located on opposite sides of a centrally located raised portion of the tang of a pliers jaw.

In another embodiment of this aspect of the invention an interference bump is provided on the raised portion of the tang of a pliers jaw to engage an interior surface of the channel-shaped handle at the same time the spring acts in a cam-following manner on the cam surface of the pliers jaws to hold a handle securely in a fully extended position with respect to the tang of a pliers jaw.

Another aspect of the present invention is the provision of a folding scissors whose blades include edges that are straight except for a serrated portion on either or both of the blades near their outer tips.

In one preferred embodiment of the folding scissors aspect of the present invention, a spring extends alongside a base portion of one of the legs of the scissors and engages the other leg of the scissors to return the scissors blades to an open position after a cutting stroke of the scissors. In a preferred embodiment of this aspect of the invention, the spring is carried on a base which is coupled to the first scissors leg yet has some freedom of movement with respect to it to permit the scissors to be folded and stowed within a cavity defined within one of the handles without tension on the spring when the scissors are stowed.

According to another aspect of the present invention a container opener includes a hook with a throat area behind the tip of the hook to provide clearance for a crimped rim of a container such as a "tin" can, and a sharp edge on the front part of the opener faces back toward the tip of the hook to cut free the top of such a container efficiently.

As yet another aspect of the present invention, interlocking portions of folded blades stowed within the cavities defined by the handles of the tool extend closely alongside each other, between such interlocks and other blades or tool bits stowed within the opposite handles, preventing the handles from moving laterally with respect to each other when the handles are folded together about the associated pliers jaws or the like.

The foregoing and other objectives, features, and advantages of the invention will be more readily understood upon consideration of the following detailed description of the invention, taken in conjunction with the accompanying drawings.

13 with the latch release mechanism holding the catch disengaged from the base of the extended tool blade.

Figure 1:
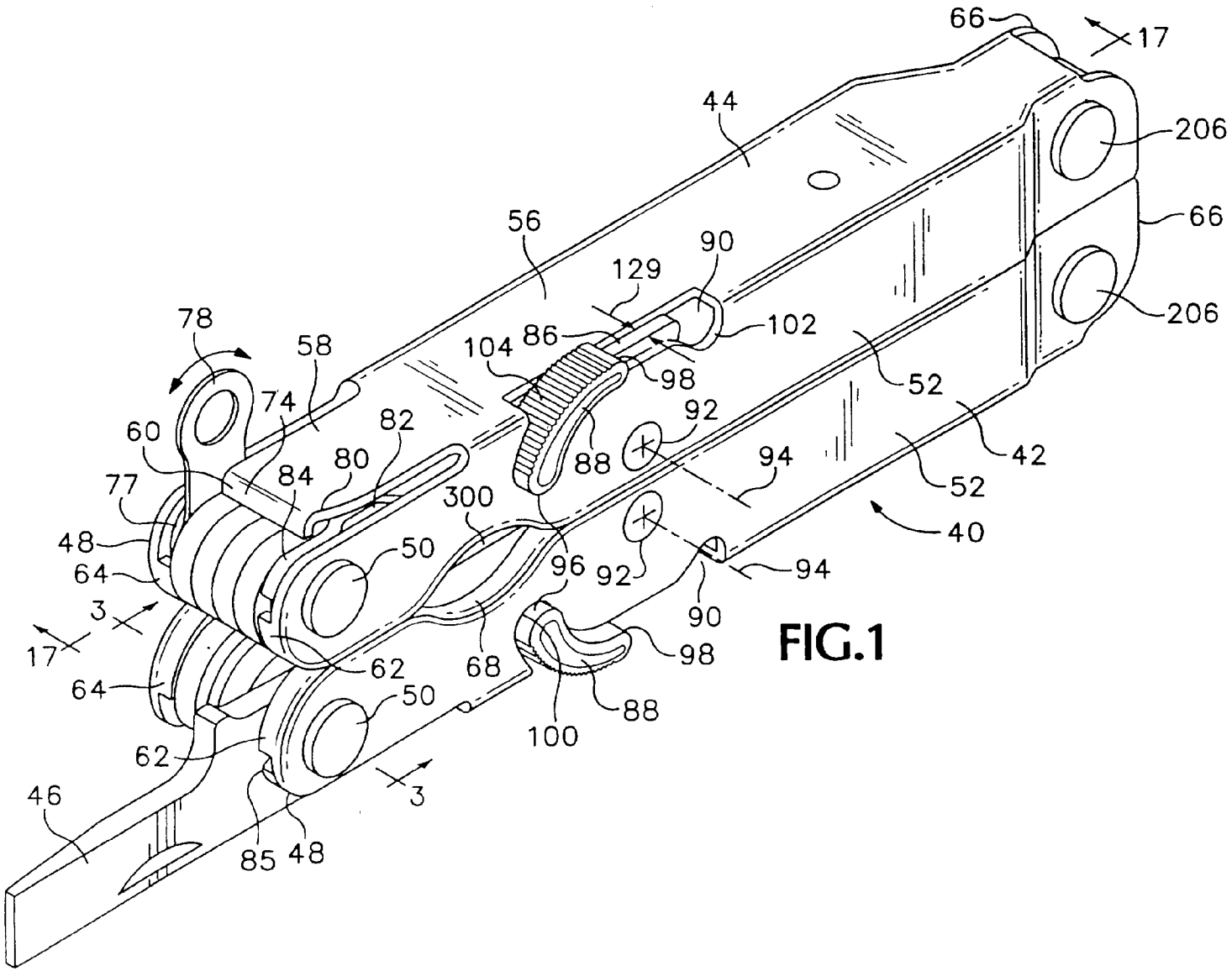
FIG. 1 is a perspective view of a folding multipurpose tool embodying the present invention with a large screwdriver extended for use.
Figure 15:
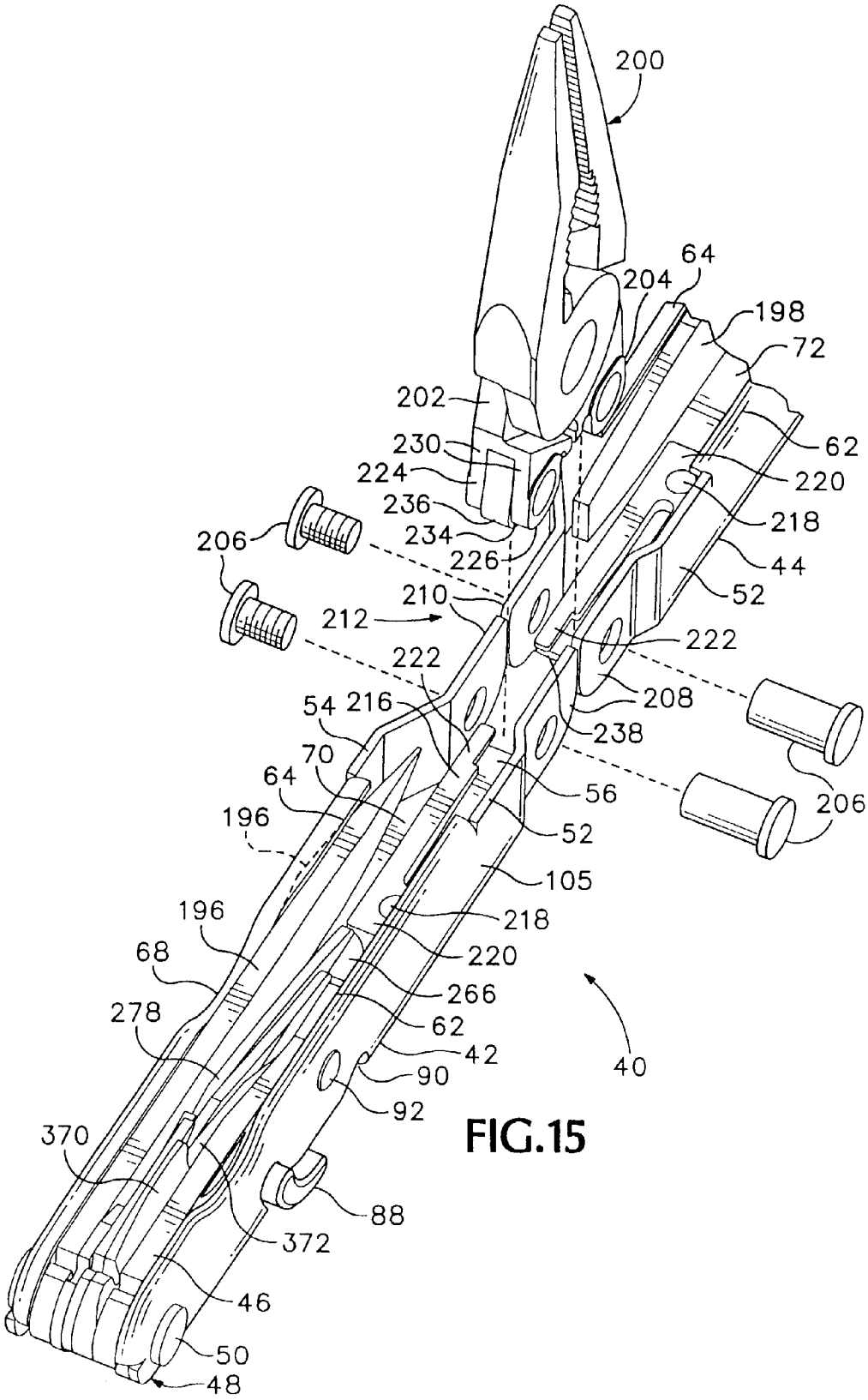

FIG. 15 is a partially exploded isometric view from above one end of one of the handles of the tool shown in FIG. 1, showing a pair of jaws and a portion of the other handle.

Figure 16:
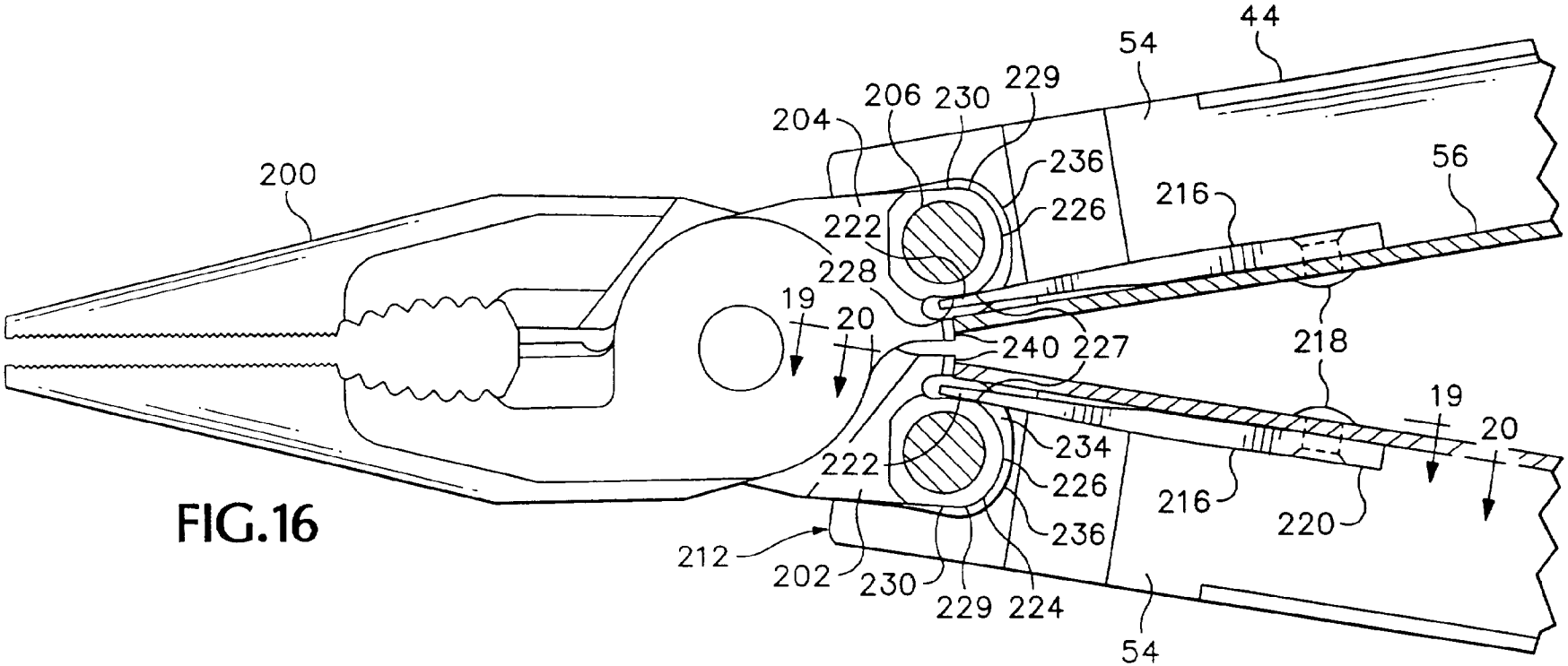

FIG. 16 is a section view of a portion of the tool shown in FIG. 1, with the handles engaged with the tangs of the jaws of a pair of pliers which are included in the tool.

Figure 17:
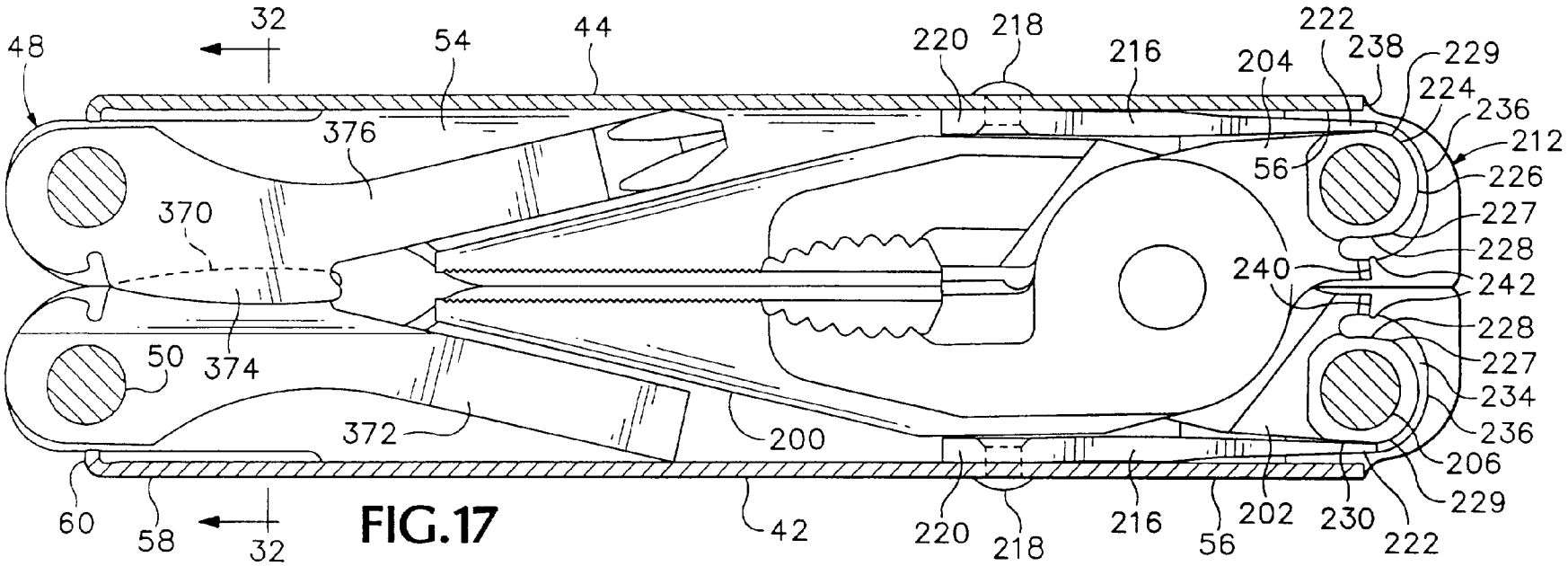

FIG. 17 is a section view taken along line 17—17 of FIG. 1, at an enlarged scale, omitting some tool blades for the sake of clarity.

Figure 18:
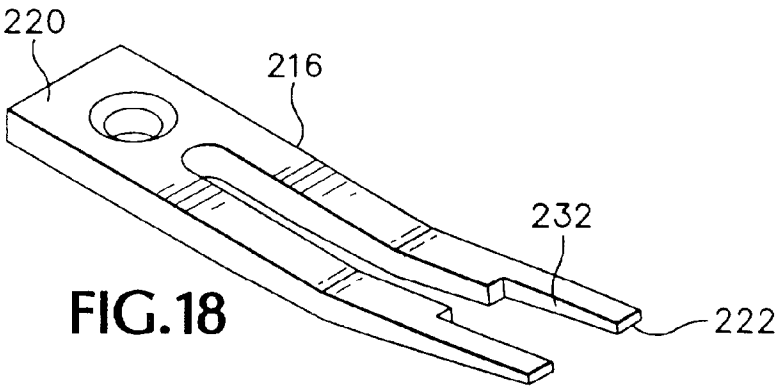

FIG. 18 is a perspective view of a spring which forms a part of a jaw handle retention mechanism which is incorporated in the invention.

Figure 19:
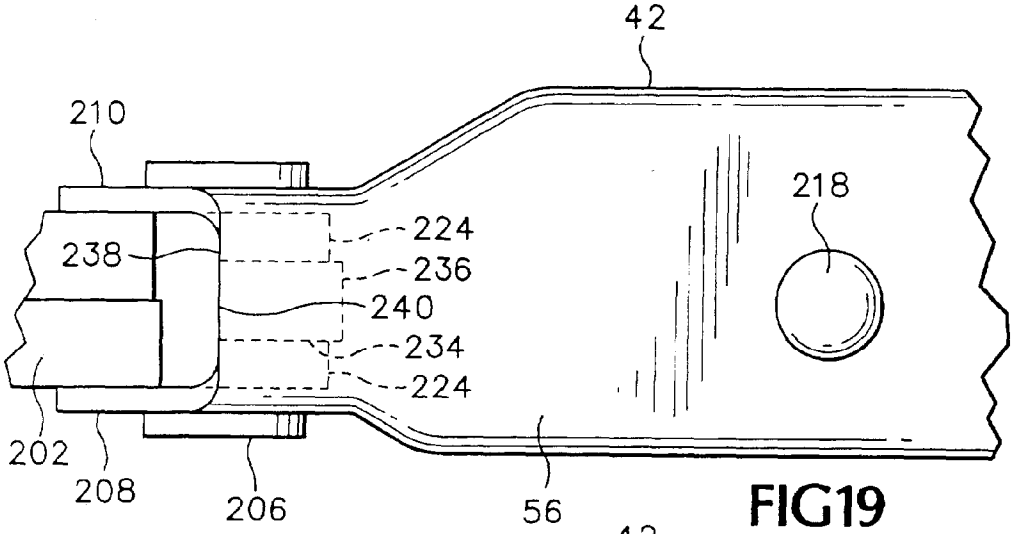

FIG. 19 is a view, taken in the direction of line 19—19 in FIG. 16, showing a portion of one of the handles of the multipurpose tool.

Figure 20:
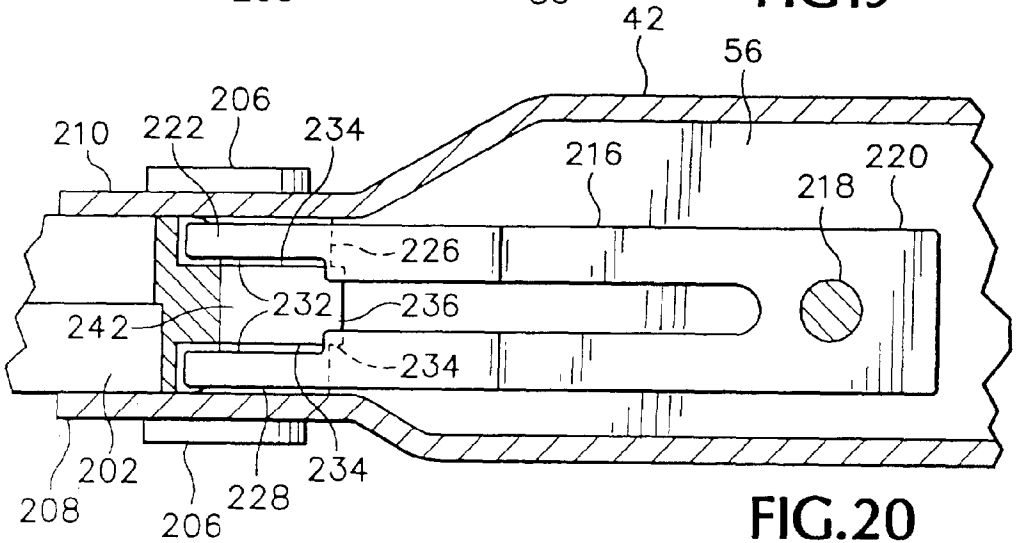

FIG. 20 is a section view taken along line 20—20 in FIG. 16, showing the relationship of a spring to the base of the pliers jaw and to the handle shown in FIG. 19.

Figure 21:
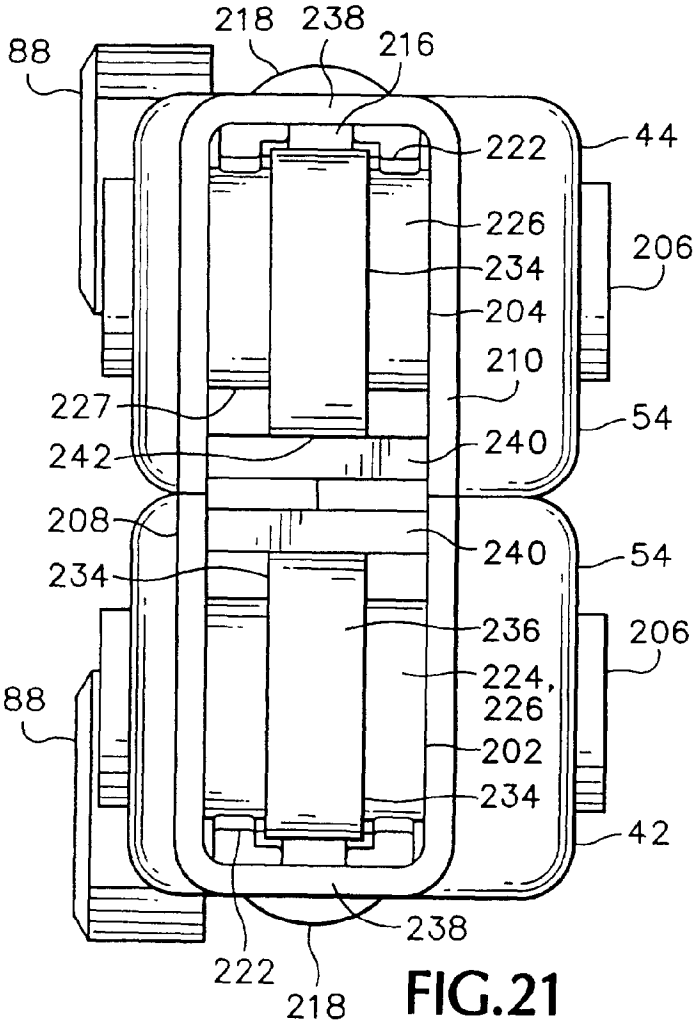

FIG. 21 is a view of the multipurpose tool shown in FIG. 1, in a folded configuration, taken from the right end of the tool as shown in FIGS. 1 and 17.

Figure 22:
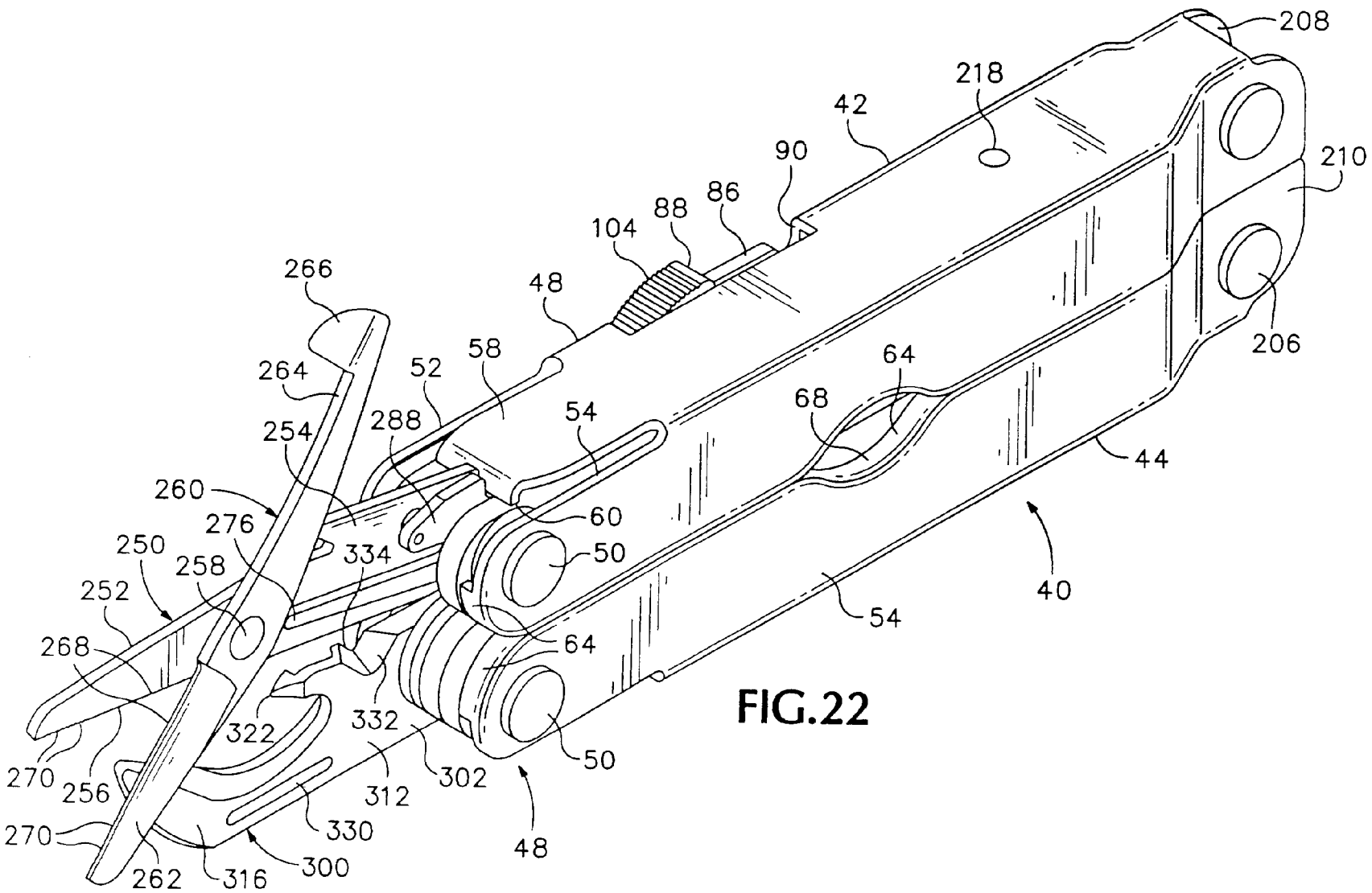

FIG. 22 is an isometric view taken from the blade pivot end of the multipurpose tool shown in FIG. 1, but with the tool rotated 180° and thus showing the opposite side of the tool from that shown in FIG. 1, and showing a pair of folding scissors and a combination bottle opener and can opener both latched into their extended positions with respect to the handles.

Figure 23:
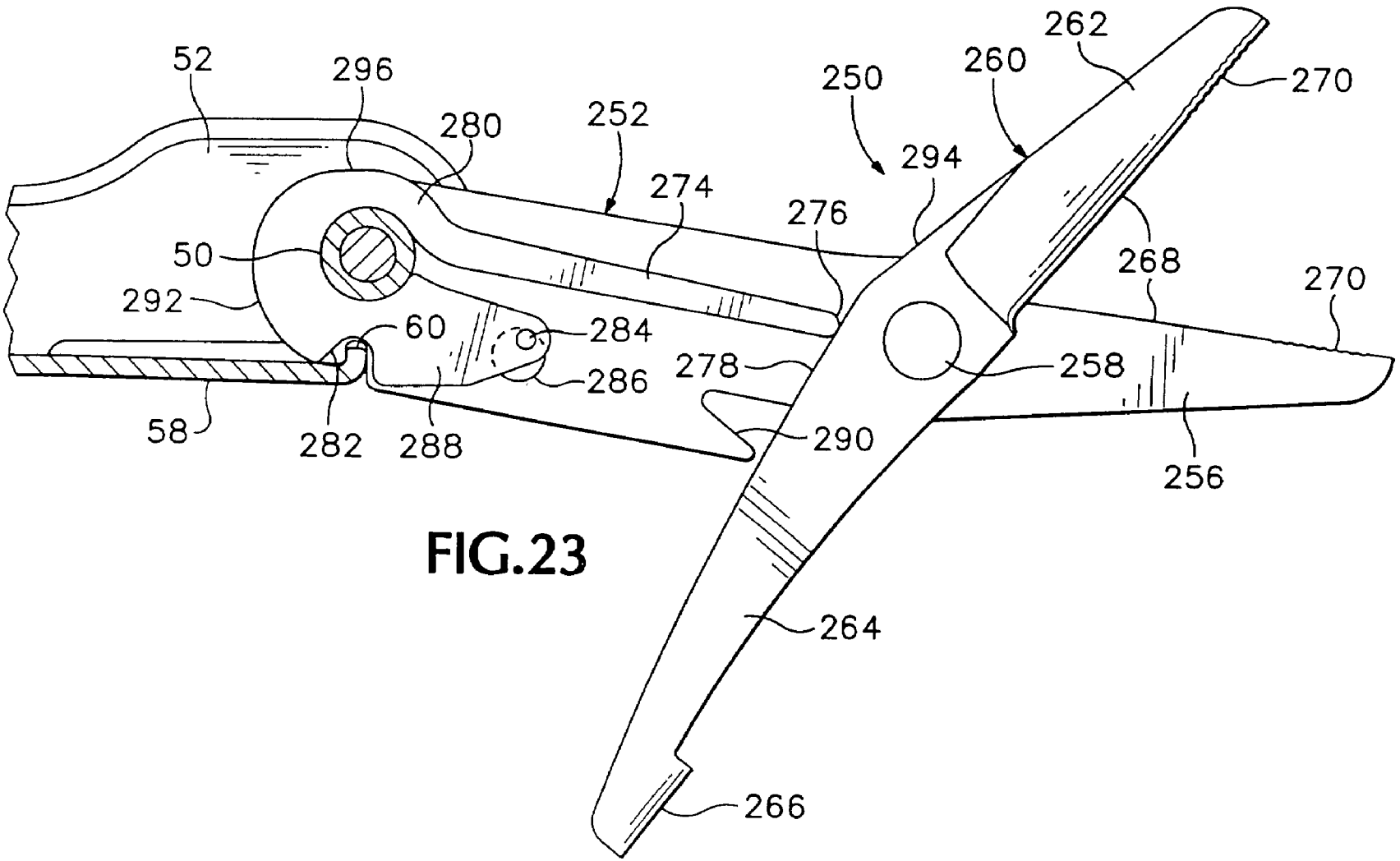

FIG. 23 is a side elevational view of the folding scissors in its fully-extended operational position, together with a partially cutaway portion of a portion of the tool handle with which it is associated, with the latch release mechanism shown in FIGS. 1–8 omitted for the sake of clarity.

Figure 24:
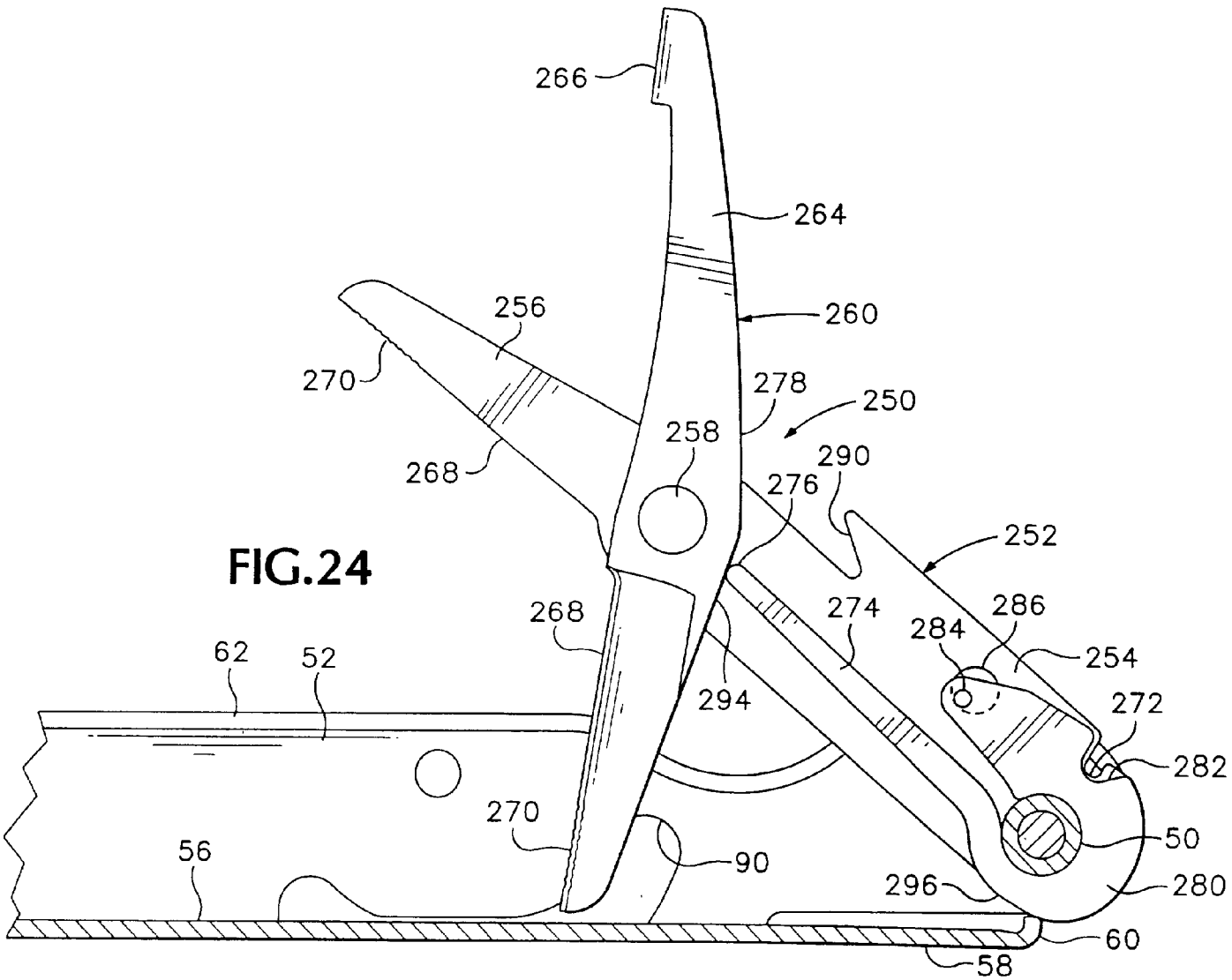

FIG. 24 is a view of the folding scissors and somewhat larger partially cutaway portion of the handle shown in FIG. 23, with the scissors in a partially folded position approaching their stowage position within the tool handle.

Figure 25:
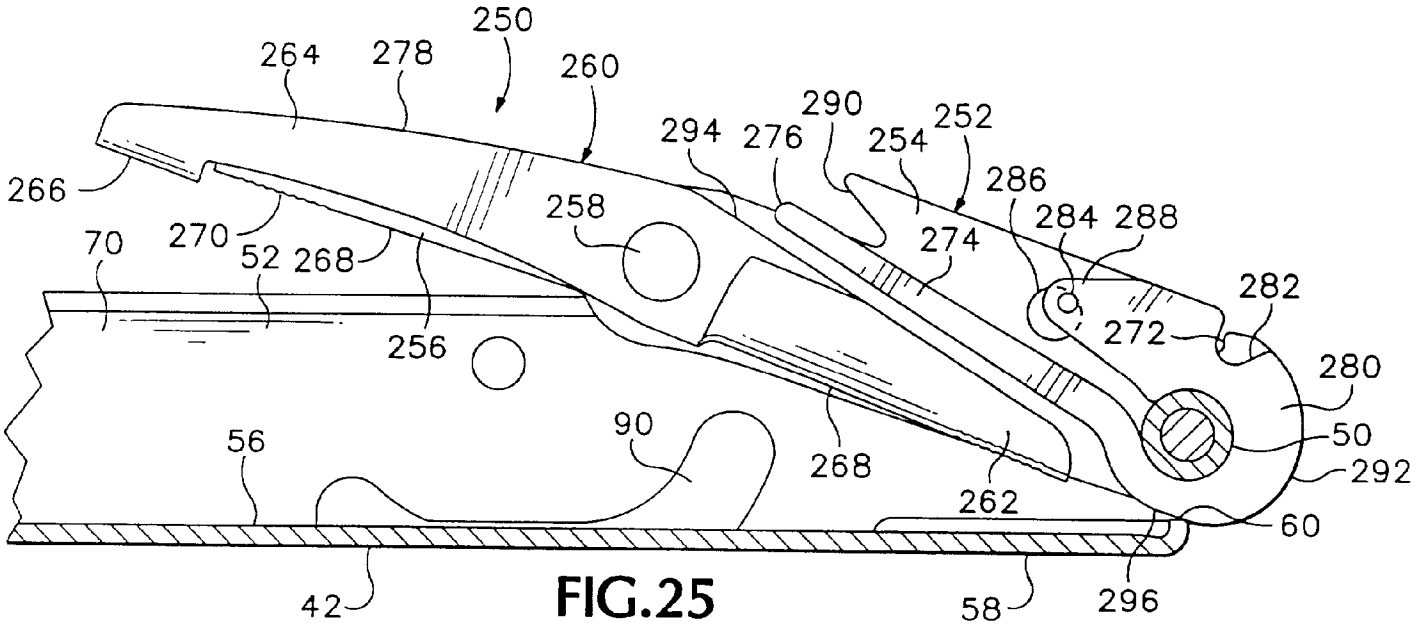

FIG. 25 is a view similar to FIG. 24, but with the scissors blades and handle moved further toward their stowage position and in the position with respect to each other required for stowage of the folding scissors within the tool handle.

Figure 26:
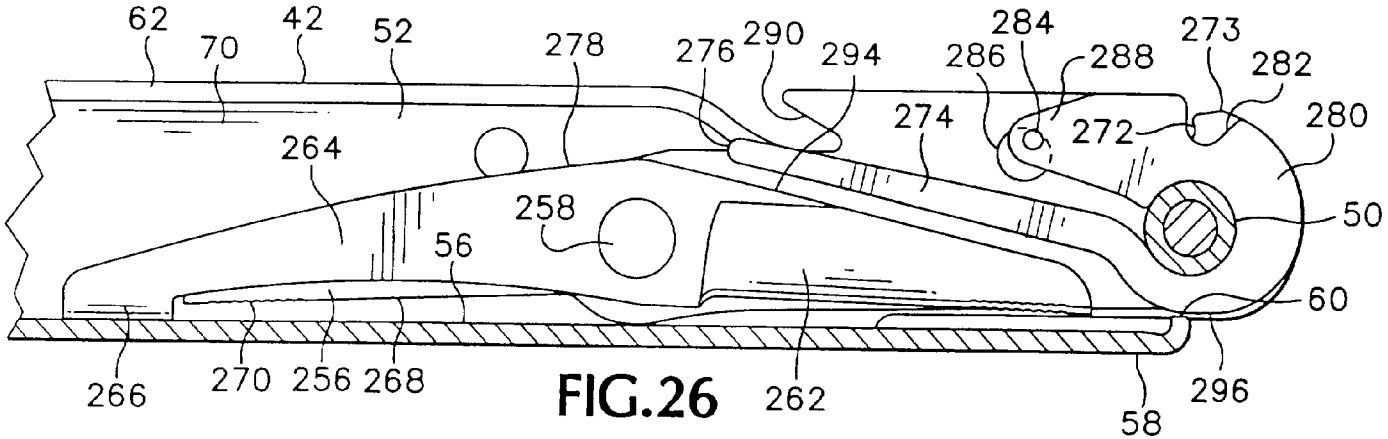

FIG. 26 is a view similar to FIG. 25, showing the folding scissors stowed within the tool handle.

FIG. 27 is an isometric view from the upper left front of a combined can opener and bottle opener included in the multipurpose folding tool shown in FIGS. 1 and 22.

FIG. 28 is a right side elevational view of the combined can and bottle opener shown in FIG. 27.

FIG. 29 is an isometric view, taken from the upper left front, of a combined bottle opener and can opener which is another embodiment of one aspect of the present invention.

FIG. 30 is an exploded isometric view taken from the upper left front of the opener shown in FIG. 29.

Figure 31:
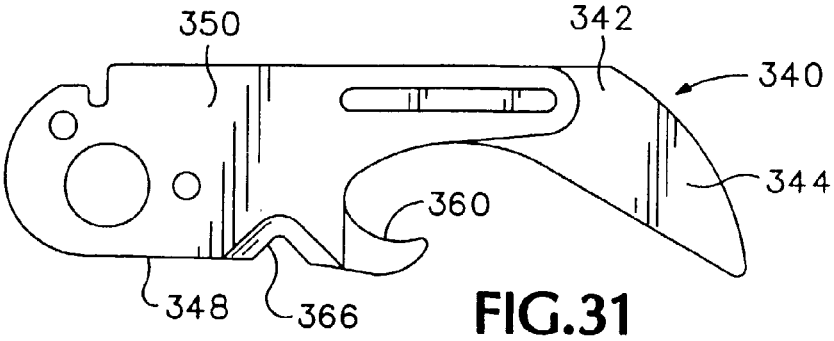

FIG. 31 is a right side elevational view of the opener shown in FIGS. 29 and 30.

Figure 32:
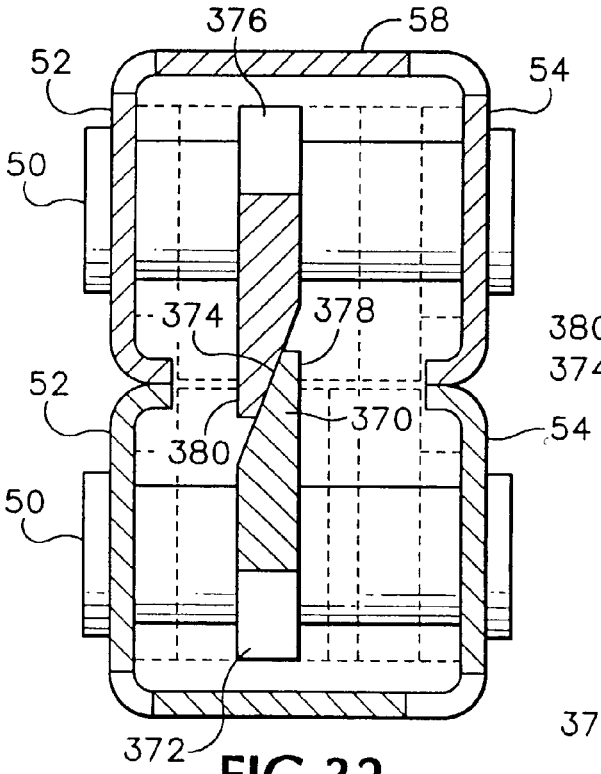

FIG. 32 is a section view taken on line 32—32 of FIG. 17, showing an interlocking relationship between two of the folded tool blades contained within the handles of the tool.

Figure 33:
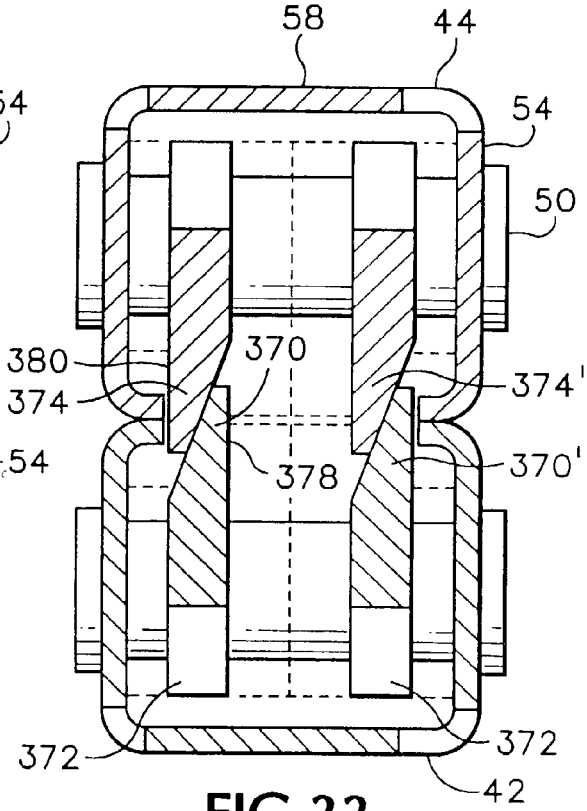

FIG. 33 is a view similar to FIG. 32 showing a tool including two pairs of interlocking blades.

Figure 34:
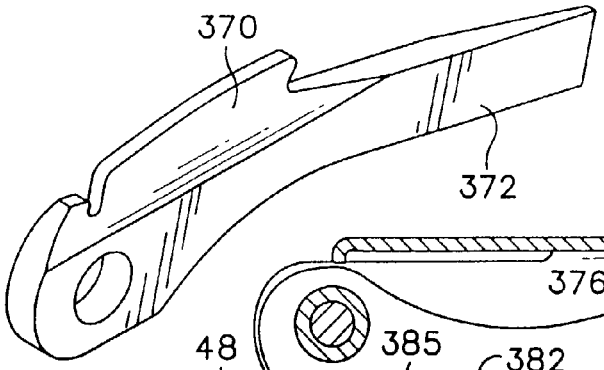

FIG. 34 is an isometric view of a screwdriver which is one of the two interlocking tool blades shown in FIGS. 17 and 32.

Figure 35:
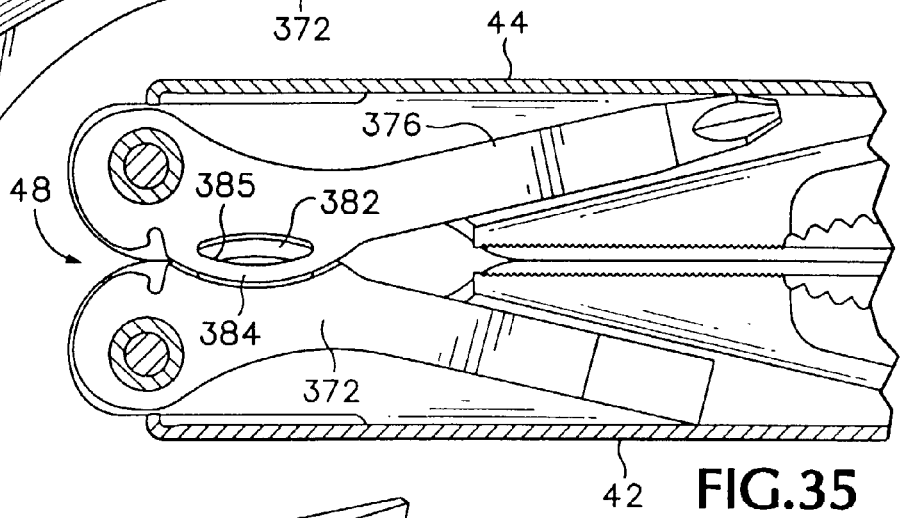

FIG. 35 is a view similar to part of FIG. 17, showing a portion of a folding tool including two interlocked tool blades of a form somewhat different from that shown in FIGS. 17 and 32.

Figure 36:
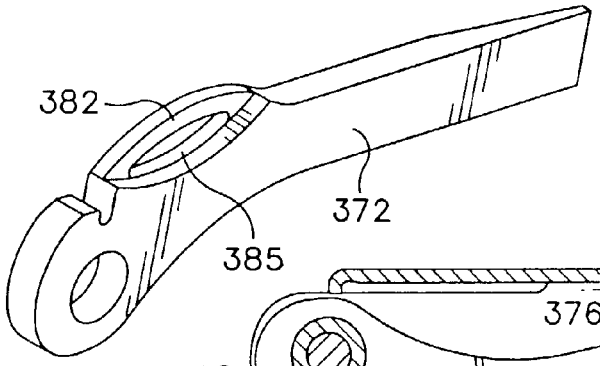

FIG. 36 is an isometric view of a screwdriver which is one of the two interlocking tool blades shown in FIG. 35.

Figure 37:
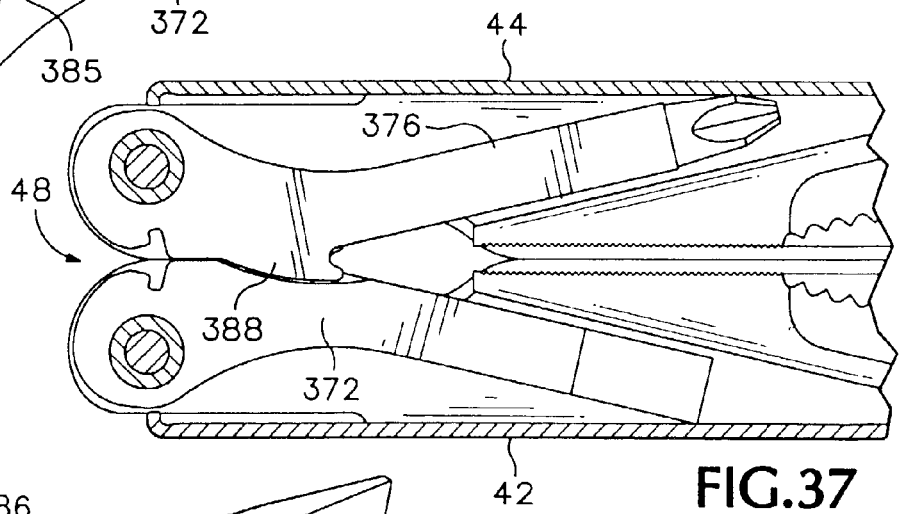

FIG. 37 is a view similar to FIG. 35 showing two interlocked tool blades of another form somewhat different from that shown in FIGS. 35 and 36.

Figure 38:
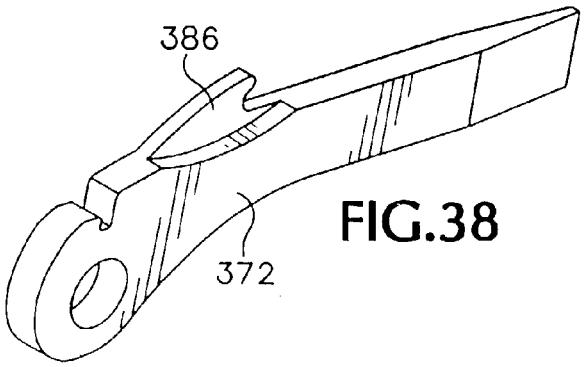

FIG. 38 is an isometric view of a screwdriver which is one of the two interlocking tool blades shown in FIG. 37.

Figure 39:
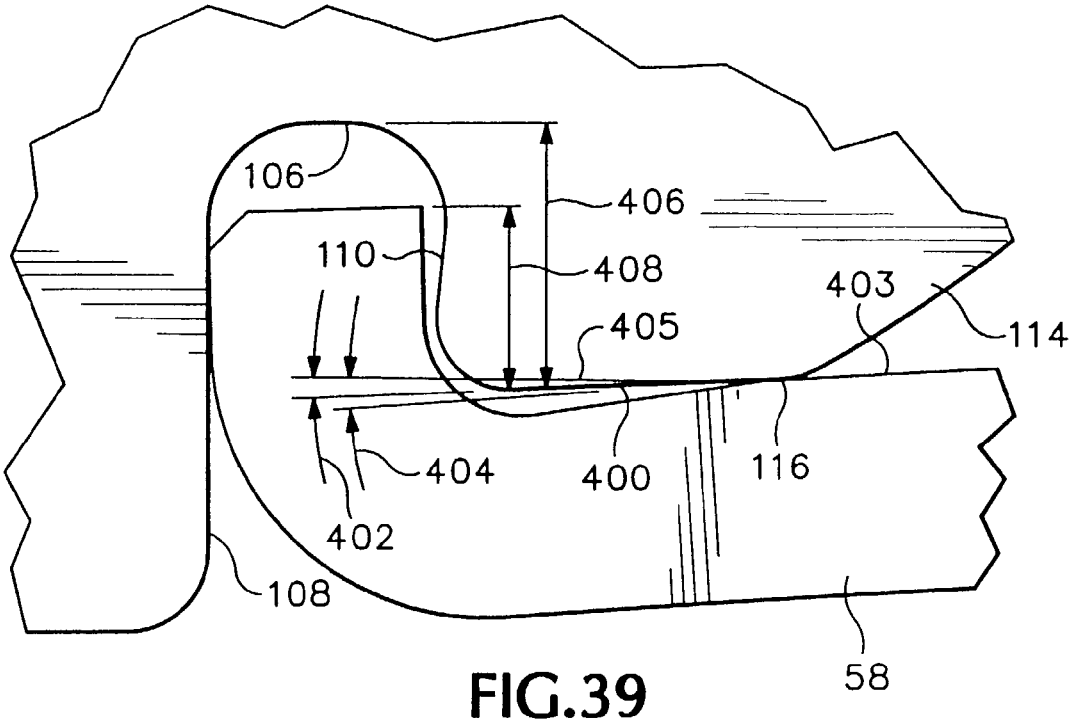

FIG. 39 is a side elevational view, at an enlarged scale, of a detail of the blade latch mechanism of the folding multipurpose tool shown in FIG. 1, showing the catch engaged in a notch to hold a folding blade in its extended position with respect to the tool handle including the latch mechanism.

Figure 40:
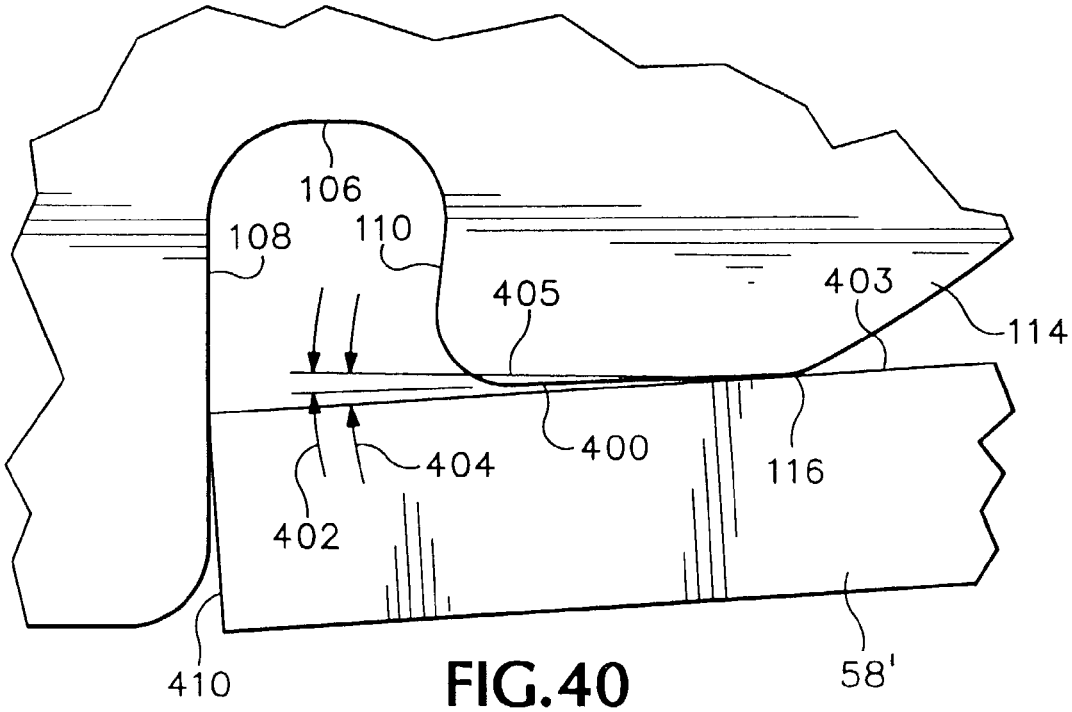

FIG. 40 is a view similar to that of FIG. 39, showing a latch spring without a catch, holding a tool blade in an extended position with respect to the handle of a multipurpose tool similar to that shown in FIG. 1.

Figures 41, 42, 43:
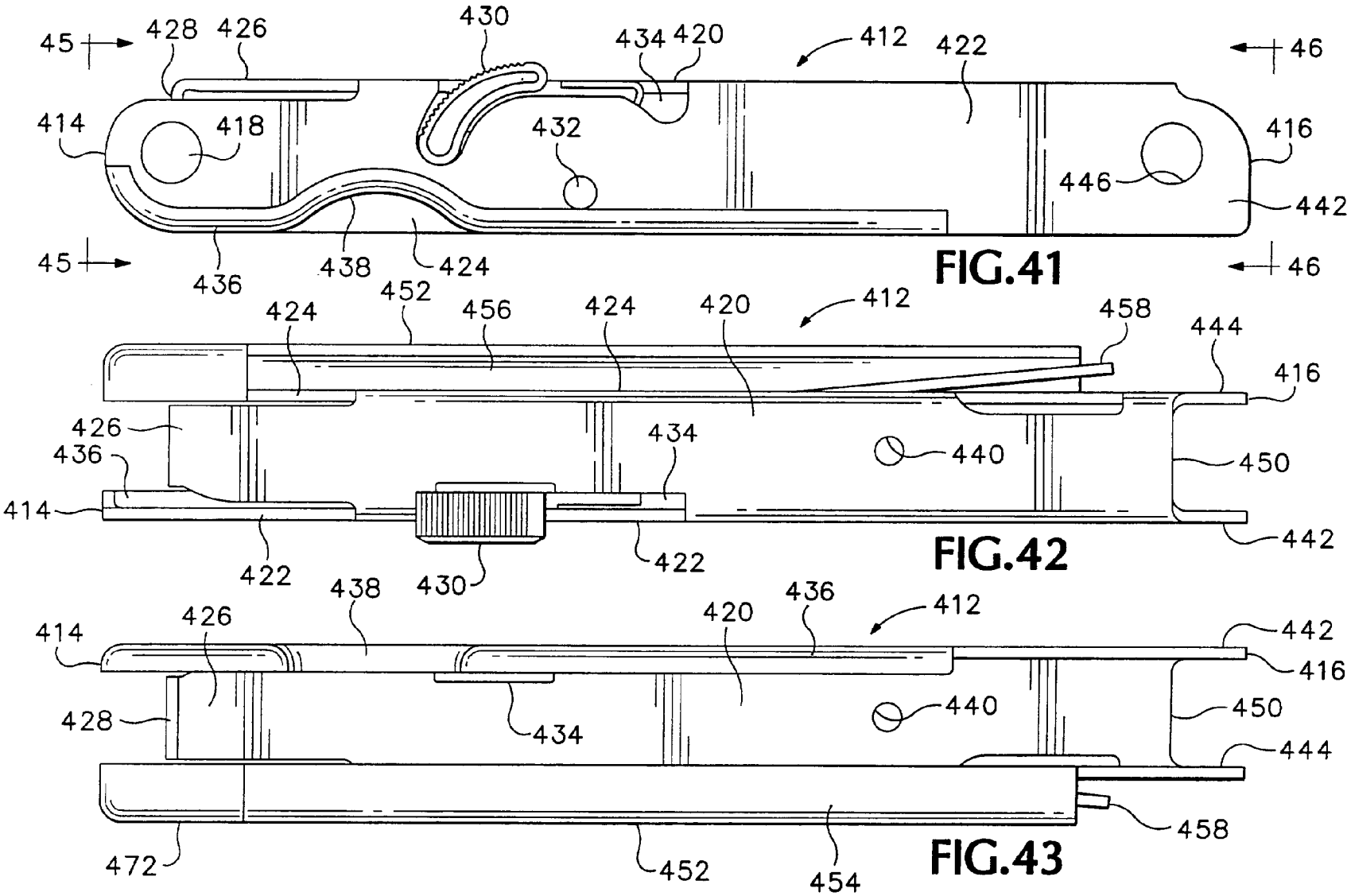

FIG. 41 is a right side elevational view of a handle for a folding multipurpose tool embodying the present invention and corresponding generally with one of the handles of the tool shown in FIG. 1.

FIG. 42 is an outside, or top plan view of the tool handle shown in FIG. 41.

FIG. 43 is an inside, or bottom plan view of the tool handle shown in FIGS. 41 and 42.

Figure 44:
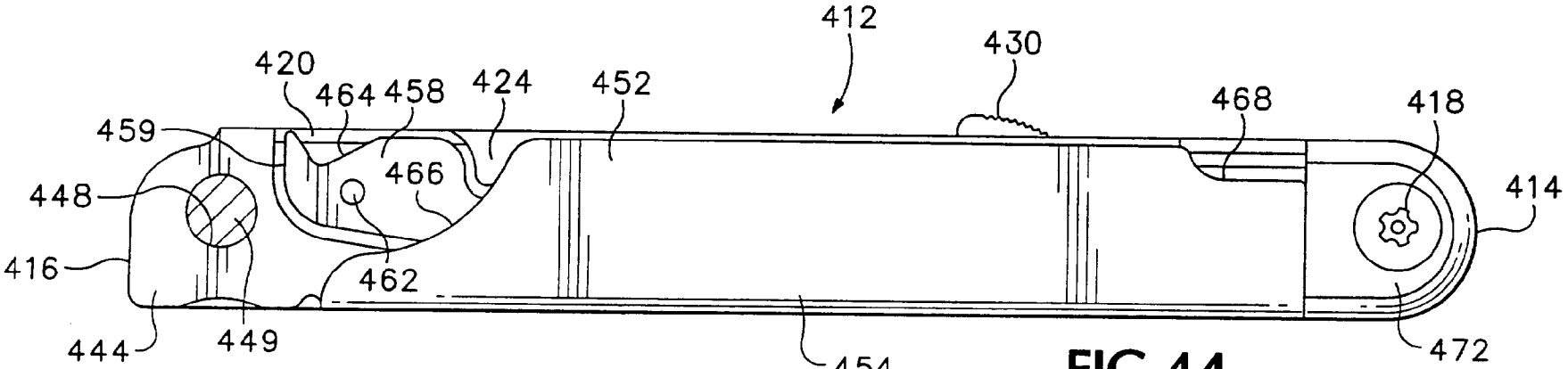

FIG. 44 is a left side elevational view of the tool handle shown in FIGS. 41–43.

Figure 45:
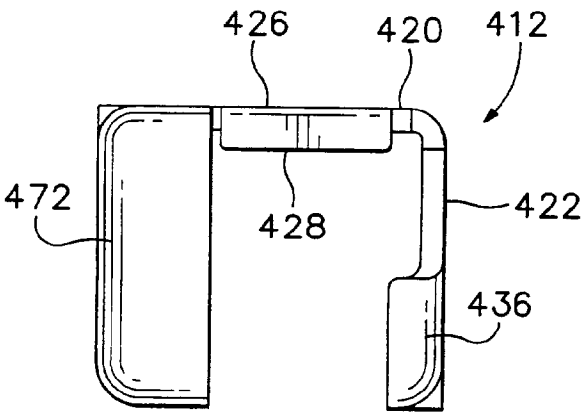

FIG. 45 is an end elevational view taken from the blade pivot end of the handle shown in FIG. 41, in the direction indicated by line 45—45.

Figure 46:
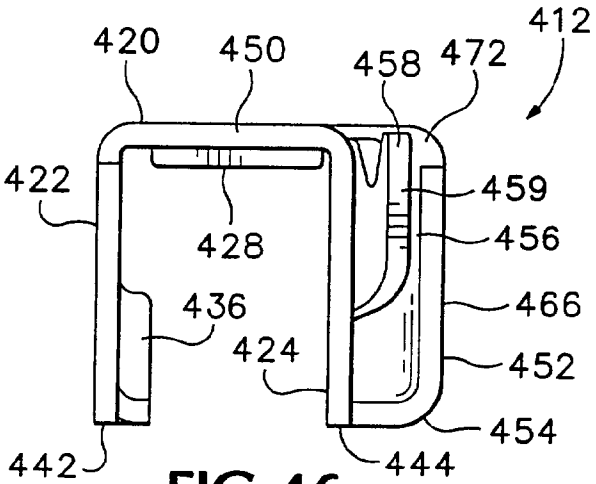

FIG. 46 is an end elevational view taken from the tool jaw end of the tool handle shown in FIG. 41, in the direction indicated by line 46—46.

Figure 47:
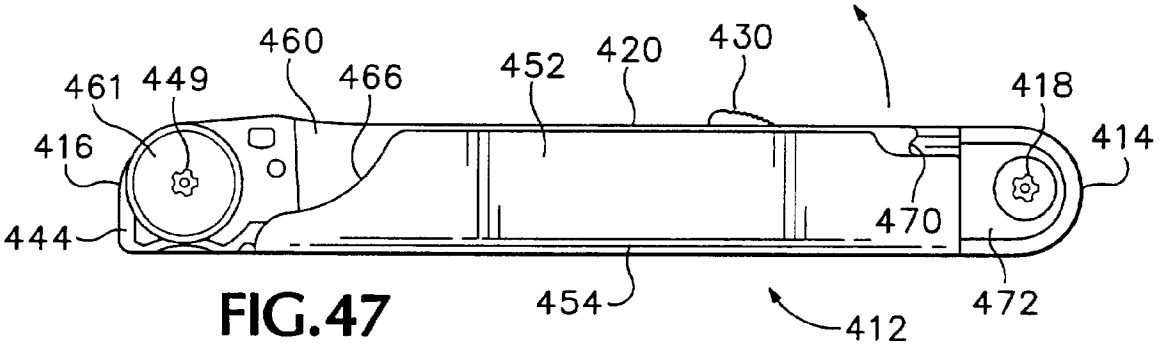

FIG. 47 is a left side elevational view of the tool handle shown in FIG. 44, together with an outer blade stowed in the side trough.

Figure 48:
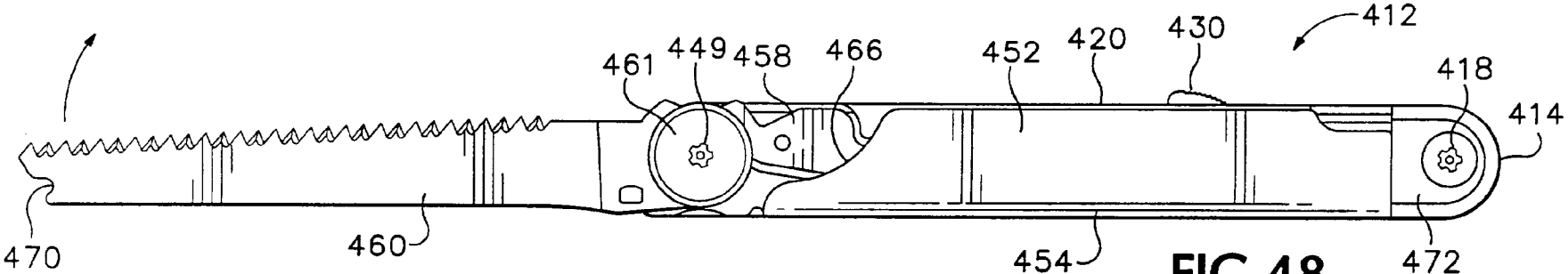

FIG. 48 is a left side elevational view of the tool handle shown in FIG. 47, shown with the outer blade extended.

DETAILED DESCRIPTION OF THE PREFERRED EMBODIMENTS

Figure 1A:
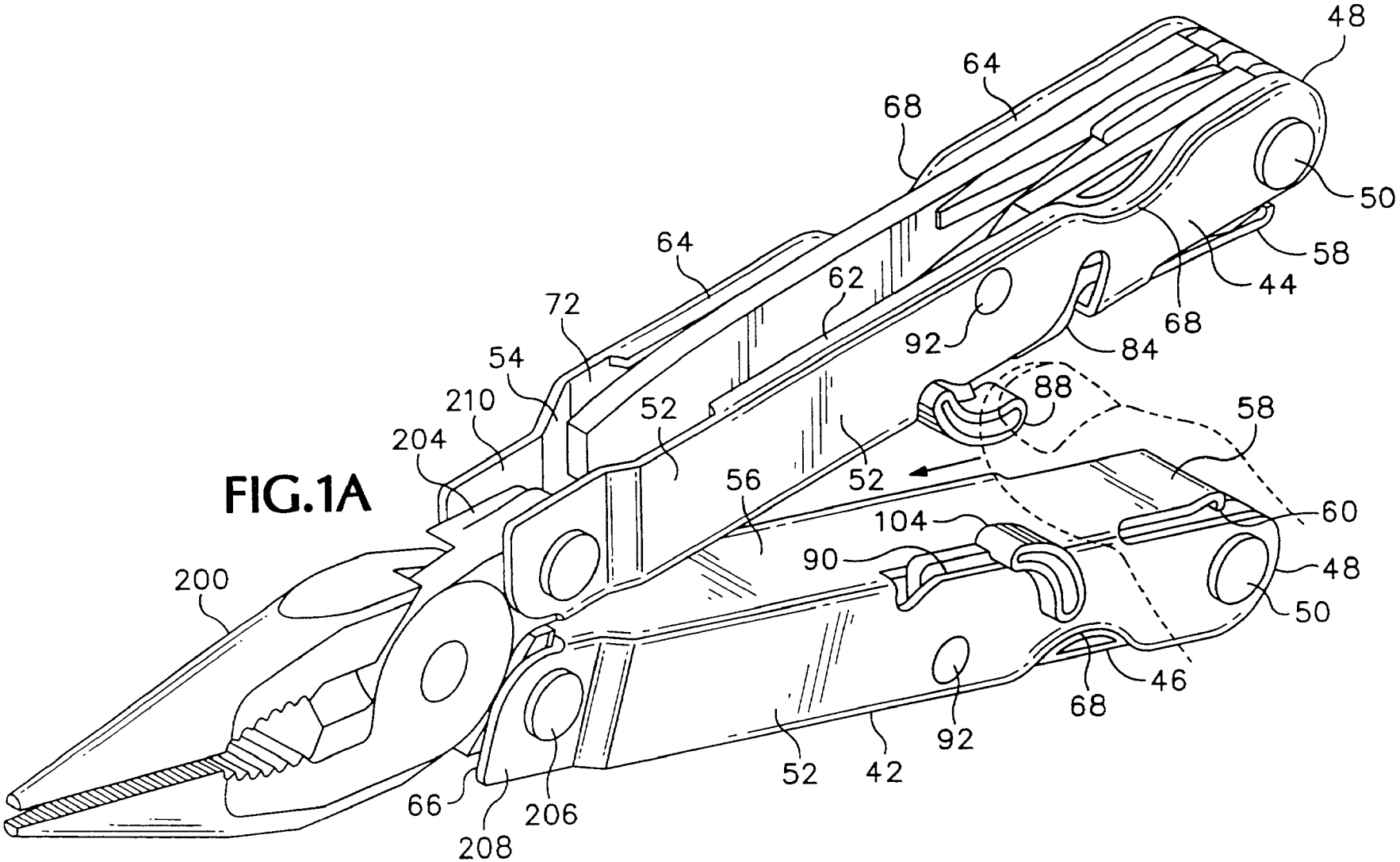
FIG. 1A is a perspective view of the folding multipurpose tool shown in FIG. 1, with the handles unfolded to deploy a pair of pliers jaws for use, and showing how a person may use a thumb to operate a blade latch release mechanism.
Figure 2:
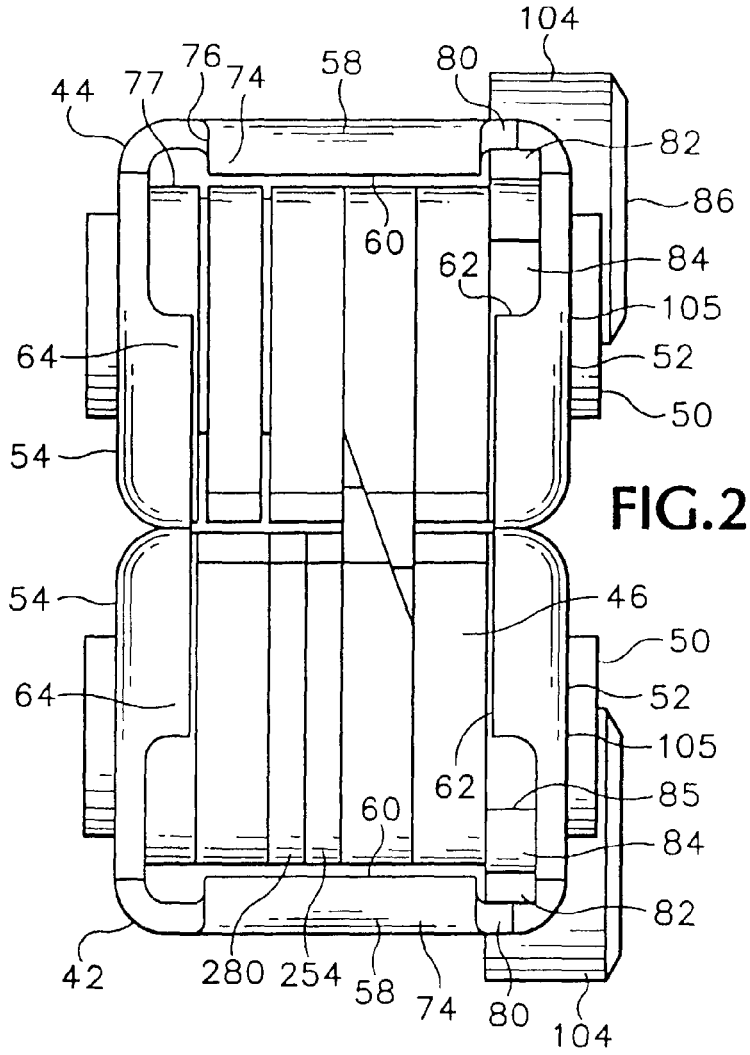
FIG. 2 is an end view taken from the left end of the multipurpose tool shown in FIG. 1, in a folded configuration, with the screwdriver shown in FIG. 1 folded.

Referring now to the drawings which form a part of the disclosure herein, a multipurpose folding tool 40 has a pair of handles 42 and 44 shown in a folded configuration in FIGS. 1 and 2, and unfolded in FIG. 1A. A straight screwdriver blade 46 is shown in an extended position in FIGS. 1 and 1A, but is shown folded into a stowage position in FIG. 2. Each handle 42, 44 has a first, or blade pivot end 48, at which various tool bits such as screwdriver blades, knife blades, files, and folding scissors are attached to the handle 42 or 44 by a respective pivot pin 50 extending through and between the opposite sidewalls 52, 54 of each handle 42, 44. The handles 42, and 44 are of sheet metal, blanked and pressed into the form of a generally U-shaped channel in which a channel base 56 is the back or outer side of each handle 42 or 44 when the multipurpose tool 40 is folded as shown in FIG. 2. The sidewalls 52, 54 join the channel base 56 along bends providing rounded corners for a comfortable grip.

Blade Latch Release

A latch spring 58 is an extension of the channel base 56, and at an outer end of the latch spring 58 the sheet metal is bent downwardly, forming a catch 60 that extends generally perpendicular to the spring 58 over substantially the entire width, or combined thicknesses, of all of the folded tool bits and blades attached to the end 48 of the handle 42 or 44. As will be explained in greater detail subsequently, the catch 60 is available to engage one or more extended tool bits or blades to keep each in its extended position.

An inwardly directed rim 62 extends along the margin of each sidewall 52, and a similar inwardly directed rim 64 extends along the margin of each sidewall 54. The rims 62, 64 merge smoothly with the sidewalls 52, 54 in a rounded surface along the margins of the sidewalls 52, 54. The rims 62, 64 are directed inwardly toward each other, extending along a portion of the end 48 of each handle 42, 44 and thence continuously along the remainder of the margin of each sidewall 52, 54 toward the opposite second, or tool jaw, end 66 of each handle. The rims 62, 64 follow the contour of each of the sidewalls 52, 54, also extending along indentations 68 (FIG. 4) in the margins of the sidewalls. The indentations 68 provide access to nail nicks of blades stored adjacent the sidewalls in the cavities 70 in the handle 42 and a cavity 72 defined in the handle 44. The rims 62 and 64, together with the rounded surfaces where the rims 62, 64 merge with the sidewalls 52 and 54, give a larger area to be gripped and squeezed, and thus provide for a more comfortable grip on the handles 42 and 44 when they are unfolded as shown in FIG. 1A, with respect to a pair of pliers jaws 200.

The latch spring 58 is separated from the adjacent sidewalls 52 and 54 along its length and is narrower, at least adjacent its outer end 74, than the space between the opposed interior edges of the rims 62 and 64, as may be seen in FIG. 2. As a result, the outer end 74 of the latch spring 58 is accessible between the sidewalls 52 and 54, and may be trimmed to the appropriate length and be bent down to form the catch 60 after the sidewalls 52 and 54 and rims 62 and 64 have been formed, if desired, during manufacture of the handles 42 and 44.

Additionally, space is provided as shown in FIG. 2 for an axial spacer 77 fitted on the pivot pin 50 adjacent the sidewall 54 of the handle 44, where the spacer 77 can be rotated alongside the margin 76 of the latch spring 58 to carry an attached lanyard eye 78 into the cavity 72 for stowage if desired.

The other side of each latch spring 58, nearer to the sidewall 52 of each handle, extends closely alongside the margin of the sidewall 52 for a majority of its length and then is tapered inward, as shown at 80. The portion of the latch spring 58 extending alongside the channel sidewall 52 is available to be contacted by a protruding shoulder 82 on a latch release lever 84 mounted on the pivot pin 50. The latch release lever 84 preferably has a portion 85 which extends radially outward away from the pivot pin 50 to conform with the profile of the cam portions of the bases of the tool bits and blades, thus offering some lateral stabilizing support against the bases of those blades, and contributing to a neat appearance of the blade pivot end 48 of the handle.

A latch release operating lever 86 includes a knob or handle portion in the form of a rocker body 88 that extends outward from the cavity 70 or 72 within each handle through an opening 90 defined by both the sidewall 52 and the channel base 56 or back of each of the handles 42 and 44. It will be understood that the openings 90 in the two handles are mirror images of each other, as are the latch release operating levers 86 located in the two handles 42 and 44. While the latch release operating lever 86 may be manufactured by traditional machining processes, it may also be manufactured by powder metallurgy or metal injection molding methods.

Each latch operating lever 86 is attached to the adjacent sidewall 52 by a fastener such as a rivet 92, defining a latch release operating lever pivot or fulcrum whose axis 94 extends normal to the sidewall 52, so that the operating lever 86 can rotate about the fulcrum in a plane parallel with and adjacent to the sidewall 52. Preferably, the rivet 92 is countersunk in the latch operating lever 86 to preserve clearance for folding tool blades to be stowed within the handles 42 and 44.

Opposite ends 96 and 98 of the rocker body 88 include limit surfaces, and portions 100 and 102, respectively, of the surfaces defining the opening 90 through the handles 42 and 44 are limit stops to be encountered by the limit surfaces of the ends 96 and 98 to limit the rotation of the latch release operating lever 86 about the fulcrum 94.

An outer face or grip surface 104 of the rocker body 88 is arcuate, and has a shape approximating a sector of a short cylinder. Preferably, outer grip surface 104 is knurled or grooved to facilitate being gripped by a persons thumb or finger. The rocker body 88 extends laterally beyond an outer face 105 of the sidewall 52, and also is exposed proud along the back 56 of the respective handle 42 or 44, making it easy to pivot the latch release operating lever 86 about its fulcrum 94, by moving either one's thumb or finger along the surface of the channel base 56 or along the sidewall 52. The somewhat larger end 96 of the rocker body 88 contributes to comfort when pushing against that end of the rocker body 88 as shown in FIG. 1A rather than against the grip surface 104 to release the catch 60 from engagement with one of the folding blades or tool bits that has been latched into a position extending from one of the handles 42 or 44. As may be seen in FIG. 1A it is practical to operate the latch release mechanism with respect to either of the handles 42 or 44 while holding the tool 40 with its handles 42 and 44 extended with respect to a pair of pliers jaws 200.

Figure 4:
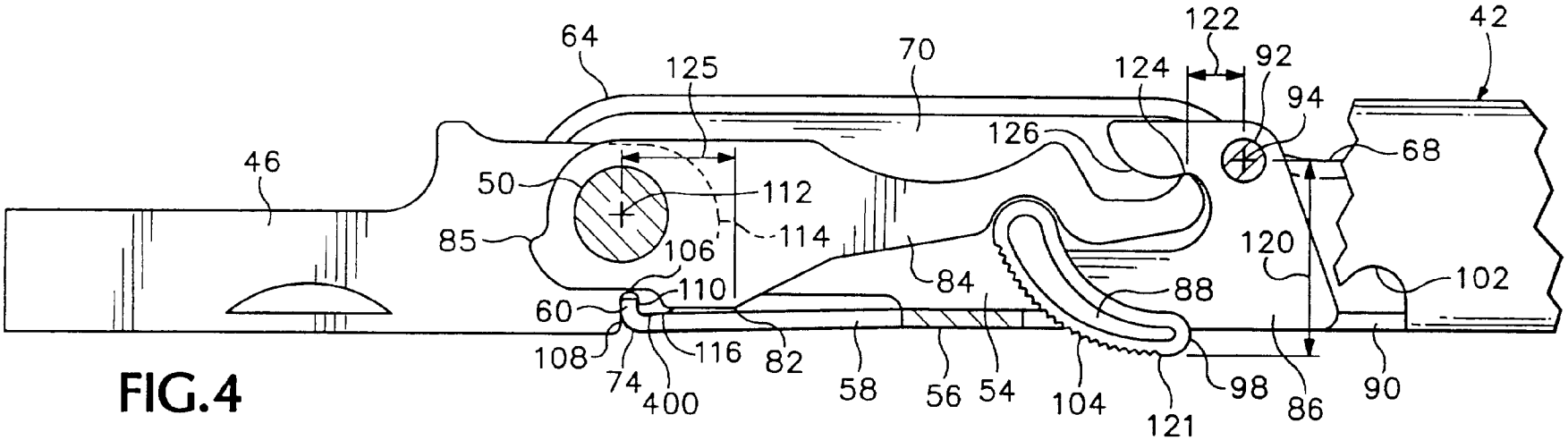
FIG. 4 is an elevational view from the near side of the lower handle of the multipurpose tool as shown in FIG. 1, partially cut away to show clearly the blade latch release mechanism, with the blade latch fully engaged to hold a screwdriver blade in an extended position as shown in FIG. 1.
Figure 5:
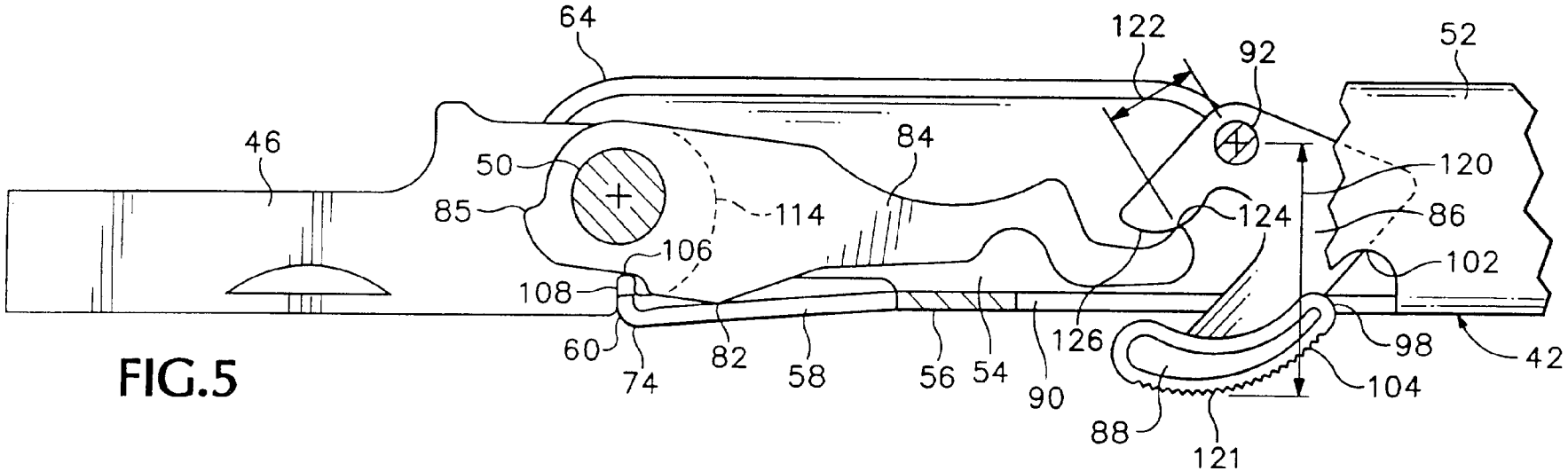
FIG. 5 is a view similar to FIG. 4, with the blade latch release operating lever moved a short distance in the direction required for releasing the latch catch from the screwdriver blade.

As may be understood more clearly with reference to FIGS. 4–8, when a blade or tool bit attached to the handle 42 by the pivot pin 50, such as the screwdriver blade 46, is latched in its open, extended position as shown in FIGS. 1 and 4, the catch 60 extends into a notch 106 in the base 114 of the blade. A shoulder 108 is engaged by an outer face of the catch 60 to prevent the blade from rotating too far in the direction of extension, while an inner face of the catch 60 engages an inner face 110 of the notch 106 to prevent the latched, extended blade from rotating about a pivot axis 112 defined by the pivot pin 50 toward a stowed position within the cavity 70.

A peripheral surface of the base 114 of the screwdriver 46 or other blade or tool bit acts as a cam, with a lobe 116 that presses against the latch spring 58, deflecting it slightly outward from its relaxed position parallel with the channel base or back 56 of the handle 42, when the catch 60 is engaged in the notch 106. Pressure of the latch spring 58 against the cam lobe 116 urges the screwdriver blade 46 toward its extended position by creating a counterclockwise moment about the pivot axis 112.

The elastic force of the latch spring 58 pressing against the lobe 116 must be overcome in moving the outer end 74 and the catch 60 far enough to disengage the catch 60 from the notch 106 in order to fold the screwdriver blade 46 into the cavity 70. This is accomplished by rotating the latch release lever 84 far enough (in a clockwise direction as shown in FIGS. 4–8) about its axis of rotation to move the shoulder 82 into contact with the latch spring 58 and by continuing movement of the latch release lever 84 in the same direction, to cause the shoulder 82 to deflect the latch spring 58 far enough to release the catch 60 from the notch 106.

In the latch release mechanism depicted in FIGS. 4–8, the latch release lever 84 is moved when the latch release operating lever 86 is moved by a person engaging the rocker body 88 with a thumb or finger.

Figure 3:
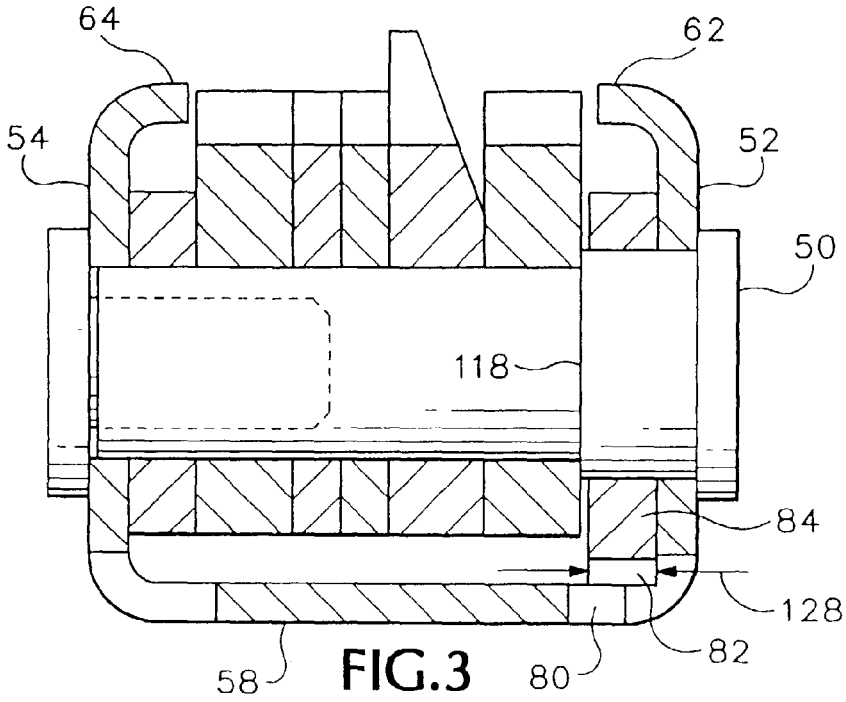
FIG. 3 is a section view, taken generally along line 3—3 in FIG. 1, showing a portion of the blade latch release mechanism as well as the bases of exemplary tool blades.

As may be seen best in FIG. 3, the pivot pin 50 is preferably a hollow-ended pin and a screw with mating threads extending through corresponding bores in the sidewalls 52 and 54. Preferably, a shoulder 118 is provided on the pivot pin 50, keeping the folding tool bits and blades including the screwdriver 46 away from the sidewall 52 to provide ample room axially along the pivot pin 50 for free rotation of the latch release lever 84 about the larger-diameter portion of the pivot pin 50.

Using this construction the axis of rotation of the latch release lever 84 coincides with the pivot axis 112 about which the folding blades and tool bits rotate between their respective extended positions and their stowed positions within the cavities 70 and 72. It will be understood, however, that it would be feasible to provide a separate axis of rotation for the latch release lever 84, as by providing a rivet connecting the latch release lever 84 with the sidewall 52.

It will be seen in FIG. 4 that the latch release operating lever 86 includes two effective lever arms. A longer lever arm 120 is present between a fulcrum 94 and an effective point of contact 121 between a person's thumb or finger and the grip surface 104 of the rocker body 88. A shorter lever arm 122 is present between the fulcrum 94 and a point of contact of an end 124 of the latch release lever 84, following a cam surface 126 of a lever lifting cam portion of the latch release operating lever 86.

It will be appreciated also that the grip surface 104 is not centered upon the pivot axis or fulcrum 94 of the latch release operating lever 86, but is eccentrically located with respect to the fulcrum 94. The grip surface 104 thus approximates a portion of a spiral expanding outward in a clockwise direction about the fulcrum 94. The effective length of the longer lever arm 120 of the latch release operating lever 86 increases as the latch release operating lever 86 is moved, because the latch release operating lever 86 is moved by pressing one's thumb toward the back 56 of the handle 42 to engage the grip surface 104 and then moving the thumb longitudinally along the back 56 of the handle in the direction away from the blade pivot end 48. Since the thumb's effective point of contact 121 moves along the grip surface 104, the longer lever arm 120 increases in length as the latch release operating lever 86 is rotated counterclockwise, away from the blade pivot end 48, to the position shown in FIG. 5. The lever arm 120 continues to increase in effective length as the latch release operating lever 86 is rotated further to the position in which the limit surface 98 encounters the stop 102, as shown in FIG. 6.

Because of the shape of the cam surface 126, however, the length of shorter lever arm 122 first increases and then decreases. Thus, for a force directed longitudinally along the back 56 of the handle 42 and applied at a point 121 where one's thumb or finger is tangent to the surface 104, as the latch release operating lever 86 is rotated to approach the position shown in FIG. 6 where the catch 60 is released from the notch 106, the combined mechanical advantage provided by the changing lengths of the longer lever arm 120 and the shorter lever arm 122 first decreases and then increases to be greater than the initial mechanical advantage. This mechanical advantage, provided as the latch release lever is moved by the latch release operating lever 86, compensates partially for the increasing force required at the end 124 to rotate the latch release lever 84 as the shoulder 82 deflects the latch spring 58 further from its relaxed position. As a result, the force that must be exerted on the grip surface 104 by one's thumb or finger, in a direction parallel with the back 56, is much less than the force required at the end 124, even as the spring 58 is deflected further and requires greater force. Also, the shoulder 82 moves slightly toward the outer end 74 of the spring 58 as the latch release lever 84 moves about its axis of rotation 112, as shown by the arrow 125 in FIG. 4 and the shorter arrow 127 in FIG. 6. This slightly lessens the increase in force required at the end 124 to move the latch release operating lever 86 further.

Figure 6:
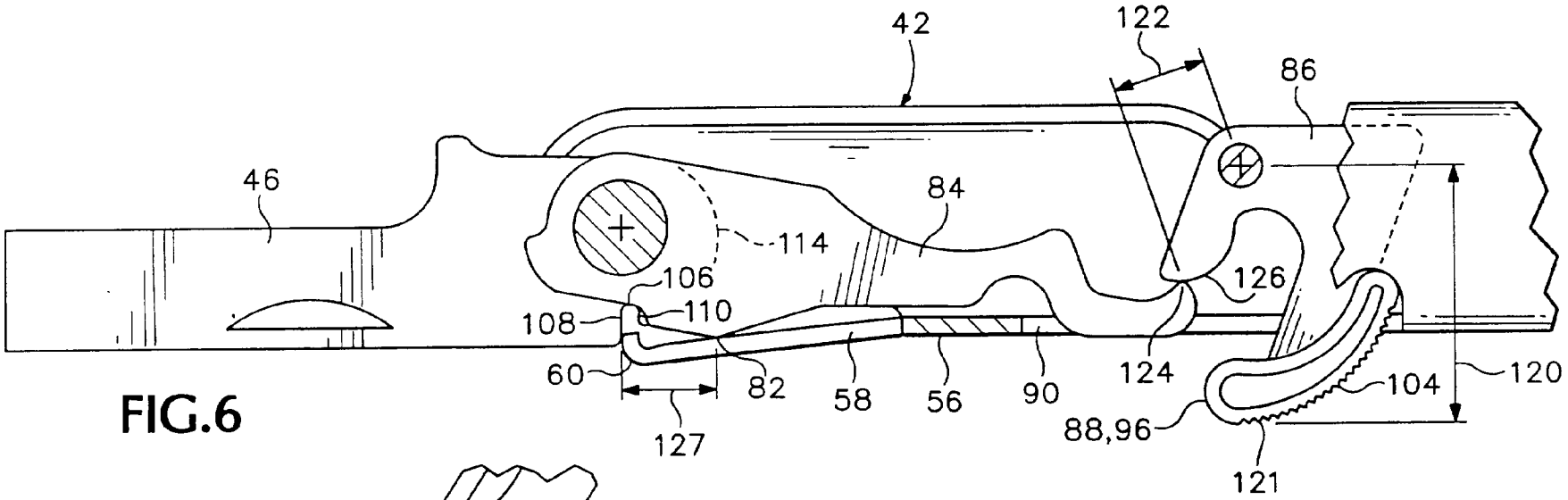
FIG. 6 is a view similar to that of FIGS. 4 and 5 showing the latch release mechanism disengaging the catch fully from the extended screwdriver blade.

When the limit surface of the end 98 of the rocker body 88 encounters the stop 102, the latch release lever 84 preferably does not protrude through the opening 90 more than a very small amount, as shown in FIG. 6, but the spring 58 is deflected sufficiently to raise the catch 60 and to release it from the notch 106, as shown in FIG. 6, allowing the screwdriver blade 46 to be rotated clockwise toward its stowed position. The stop 102, moreover, prevents the latch release lever 84 from flexing the latch spring 58 beyond its elastic limit.

Figure 7:
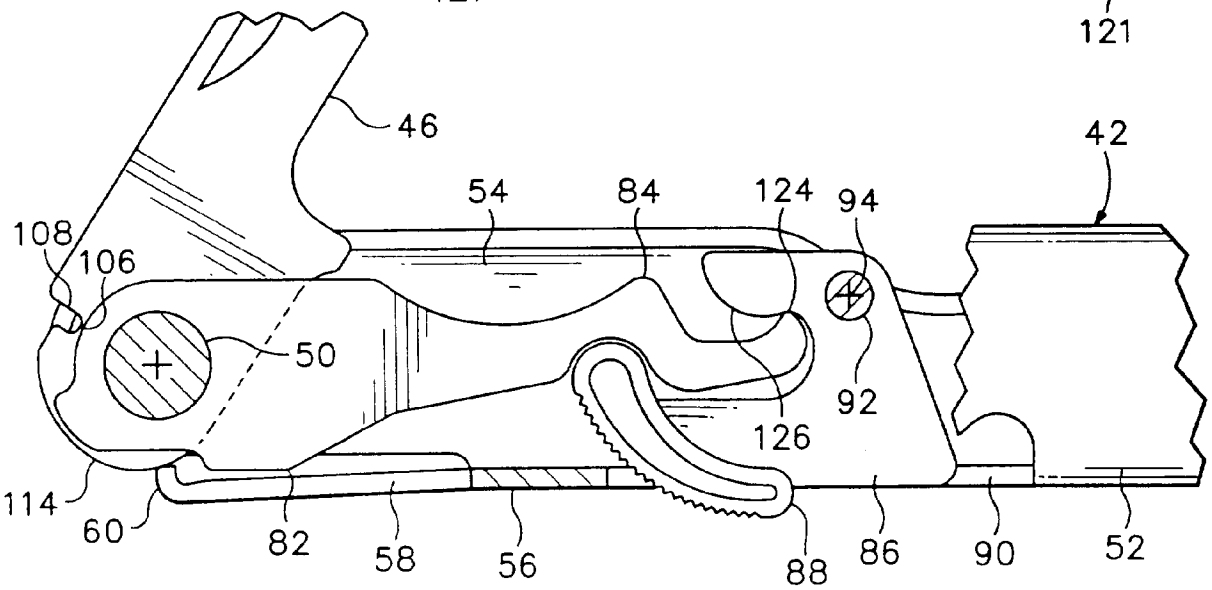
FIG. 7 is a view similar to that of FIG. 4, but with the screwdriver blade partly folded toward its stowage position so that a cam portion of the base of the screwdriver blade displaces the latch spring away from the latch release lever of the latch release mechanism.
Figure 8:
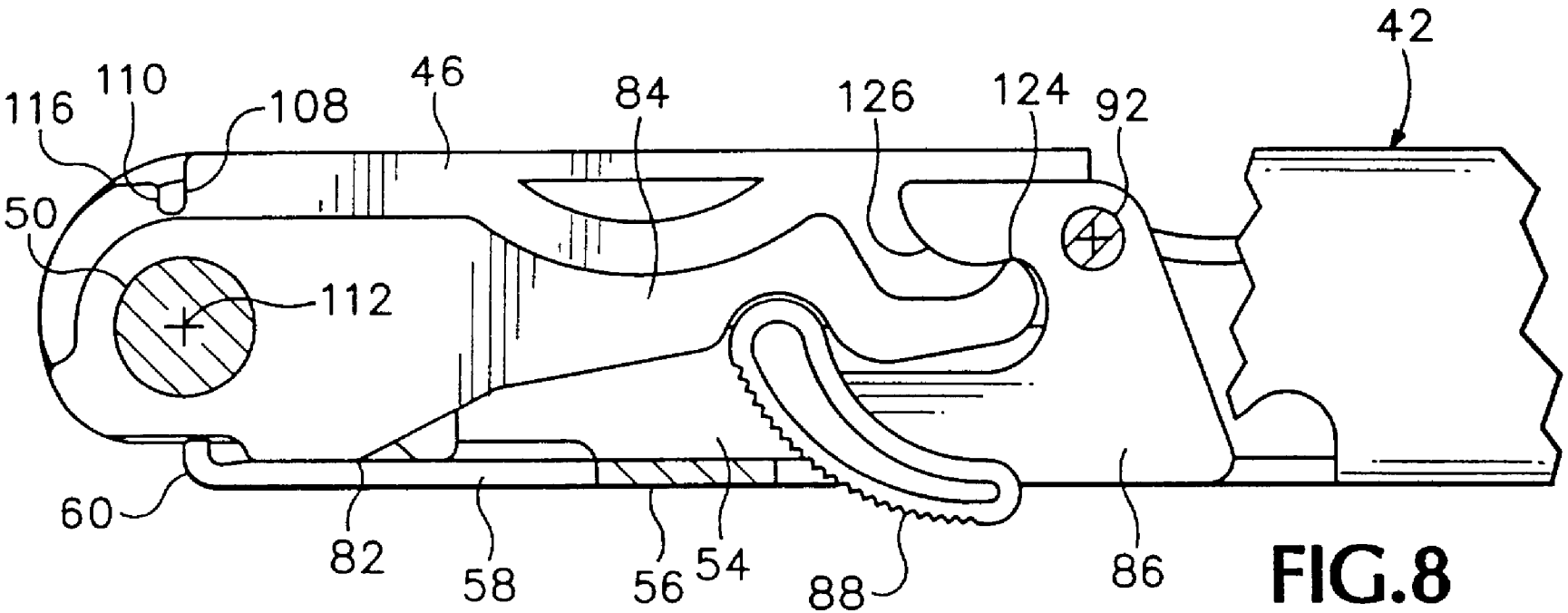
FIG. 8 is a view similar to that of FIG. 4, but with the screwdriver blade folded into its position for stowage in the handle, and with the latch release mechanism in a relaxed state.

As shown in FIG. 7, a peripheral surface of the base 114 of the screwdriver blade 46 acts as a cam followed by the catch 60 as the spring 58 moves back toward its substantially relaxed position shown in FIG. 8. Preferably, sufficient pressure is provided against the sides of the bases of the tool bits and blades, by the shoulder 118 and the head of the pivot pin 50 adjacent the outer side of the sidewall 54, to keep the tool bits and blades from flopping too easily out from their respective stowed positions in the cavities 70 and 72. Once a tool bit or blade has been moved a part of the way toward its respective extended position, the base 114 of each will act as a cam to lift the catch 60, which can follow the cam surface until the catch 60 can engage itself into the respective notch 106.

Preferably, the latch release lever 84 has a thickness 128 (FIG. 3) which is greater than the thickness 129 (FIG. 1) of the latch release operating lever 86, assuring that the adjacent one of the blades stowed within the cavity 70 or 72 does not interfere with the latch release operating lever 86.

When all of the tool bits or blades in one of the handles 42 and 44 are in their stowed positions, as shown in FIG. 8, the latch spring 58 preferably rests on the shoulder 82 of the latch release lever 84 with a small amount of pressure biasing the latch release lever 84 in a counterclockwise direction as shown in FIG. 8. This urges its outer end 124 against the cam portion, in turn urging the latch release operating lever 86 to rotate clockwise and thus bringing the limit surface of the end 96 of the rocker body 88 into engagement against the stop 100. The latch release lever 84 includes a crook in its shape, fitting around the shape of the stop surface 100, yet leaving a small amount of clearance, as shown in FIG. 8. Thus, when all of the tool bits and blades in the handle 42 or 44 are stowed within the respective cavity 70 or 72, the rocker body 88 is held against the stop 100 with a small force originating from the latch spring 58, and the latch release lever 84 and operating lever 86 are not free to rattle.

As shown in FIGS. 9, 10, 11, 12, 13, and 14 various other latch releasing mechanisms could also be used in conjunction with the configuration of the handles 42 and 44. The rims 62 and 64 define a convenient space to receive a latch release lever without taking up space in which folding blades can be stowed within a handle and moved to an extended position with respect to the handle.

Figure 9:
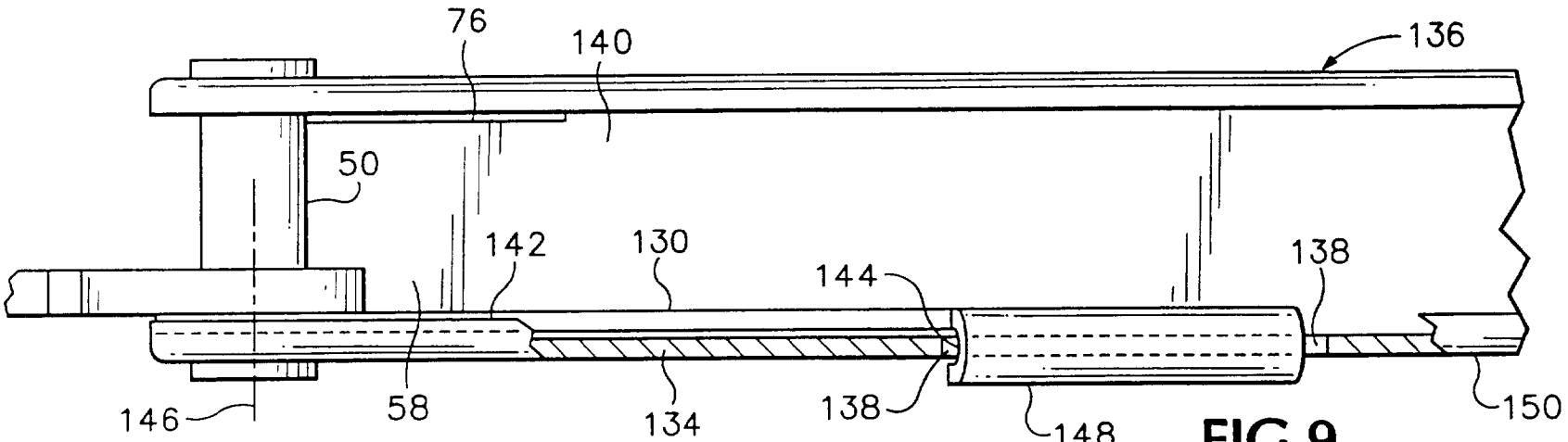
FIG. 9 is a top plan view of a portion of a handle and a portion of a blade for a multipurpose tool similar to that shown in FIG. 1, but including a different latch release mechanism associated therewith.

In particular, as shown in FIG. 9, a latch release lever 130 corresponds in function with the latch release lever 84 in the handle 42 or 44 and a main arm of the latch release lever 130 extends alongside an inner face of the sidewall 134. Similar to the shoulder 82 on the latch release lever 84, there is a shoulder 132 on the latch release lever 130 that presses against the latch spring 58 to deflect it and disengage the catch 60 from the notch 106 of an extended tool blade such as the screwdriver 46 when the latch release lever 130 is pushed to the position shown in FIG. 10.

Figure 10:
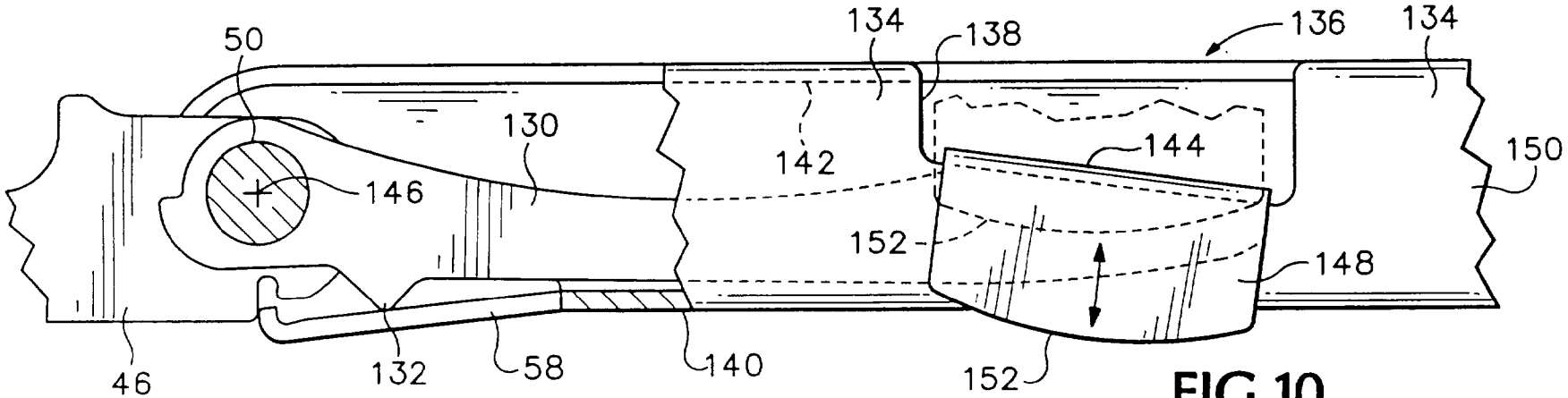
FIG. 10 is a partially cutaway side elevational view of the portions of a tool handle and extended blade shown in FIG. 9, with the latch release mechanism holding the catch disengaged from the base of the extended tool blade.

A portion of the sidewall 134 of the tool handle 136 shown in FIGS. 9 and 10 defines an opening 138 extending from the outer margin of the sidewall 134 toward the back 140, or channel base portion of the handle 136. The opening 138 thus interrupts the rim 142, corresponding to the rim 62, providing a space through which a U-shaped portion 144 of the latch release lever 130 can move as it is rotated about a pivot axis 146 defined in this embodiment of the invention by the pivot pin 50. It will be understood that the pivot axis 146 could be located elsewhere, although it is convenient to allow the latch release lever arm 130 to rotate about the pivot pin 50 as shown.

On the outside of the tool handle 136 a flat handle or grip portion depends from the U-shaped portion 144 and includes an outwardly facing grip surface 148. The flat grip portion extends closely alongside the outer face 150 of the sidewall 134. The bottom of the opening 138 encounters the U-shaped portion 144 as a stop to prevent the shoulder 132 from flexing the latch spring 58 beyond its elastic limit.

When the latch release lever 130 is not being utilize to unlatch an extended blade, the U-shaped portion 144 is aligned with the rim 142, and a lower margin 152 of the flat grip portion rests alongside the outer face 150, as shown in broken line in FIG. 10. This keeps the latch release lever 130 mainly within space defined and protected by the rim 142, so that contact of the upper side of the latch release lever arm 130 against the lower surface of the rim 142 keeps the U-shaped portion 144 from pivoting outward beyond a related position aligned with the margin of the sidewall 134.

Figure 11:
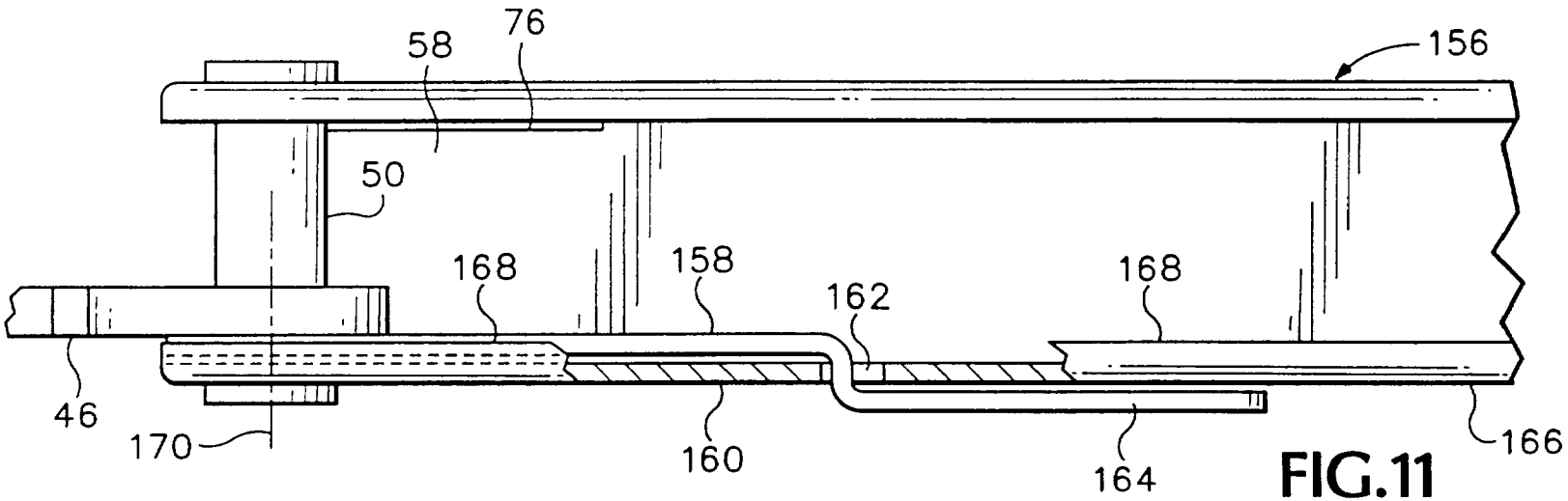
FIG. 11 is a top plan view of a portion of a handle and a portion of a blade for another multipurpose tool similar to that shown in FIG. 1, but including another different latch release mechanism.
Figure 12:
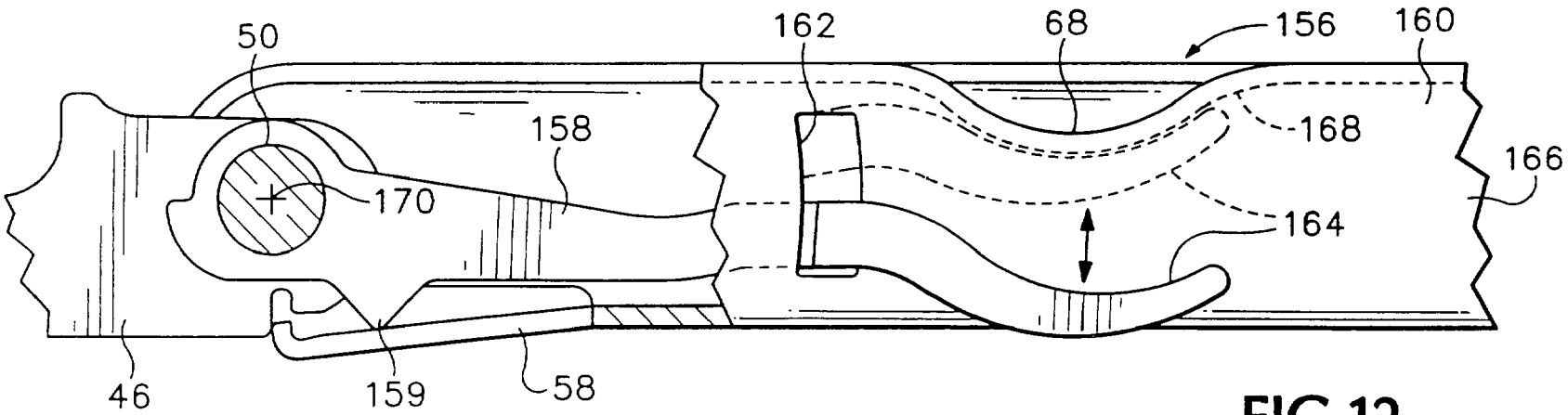
FIG. 12 is a partially cutaway side elevational view of the portions of a tool handle and extended blade shown in FIG. 11, with the latch release mechanism holding the catch disengaged from the base of the extended tool blade.

In another embodiment of the invention, as shown in FIGS. 11 and 12, a tool handle 156 includes a latch release lever 158, with a shoulder 159 engaging the latch spring 58, similar in its operation to the latch release lever 130. In the handle 156, however, a sidewall 160 defines a slot 162 through which extends a portion of the latch release lever 158 including a hook 164 that extends alongside and parallel with an outer face 166 of the sidewall 160. When the latch release lever 158 is in its relaxed, or inoperative position, not being used to release the catch 60 from the notch 106 of the blade 46, the outer end or hook 164 is located slightly below the indented portion 68 of the rim 168, with an upper surface of the latch release lever 158 engaging an inner surface of the slot 162. The latch release lever 158 is similarly prevented from moving too far toward the spring 58 by encountering a bottom surface of the slot 162.

The rim 168 corresponds with the rim 62 described previously, and also extends along the indented portion 68 of the sidewall 160, as in the handles of the tool 40 described above. As in the handles 42 and 136, the latch release lever 158 is mounted to rotate about the pivot pin 50, and thus its axis of rotation 170 coincides with the central axis of the pivot pin 50, although the latch release lever 158 could be attached to the handle 156 to rotate about a different axis of rotation if desired.

Figure 13:
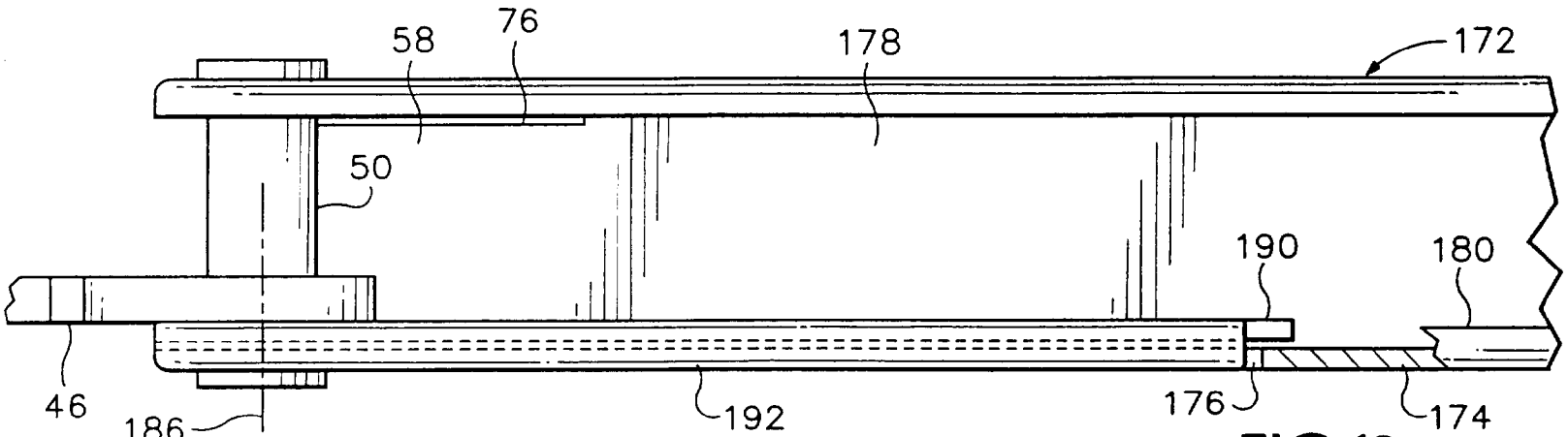
FIG. 13 is a top plan view of a portion of a handle and a portion of a blade for yet a further multipurpose tool similar to that shown in FIG. 1, but including yet a different latch release mechanism associated therewith.
Figure 14:
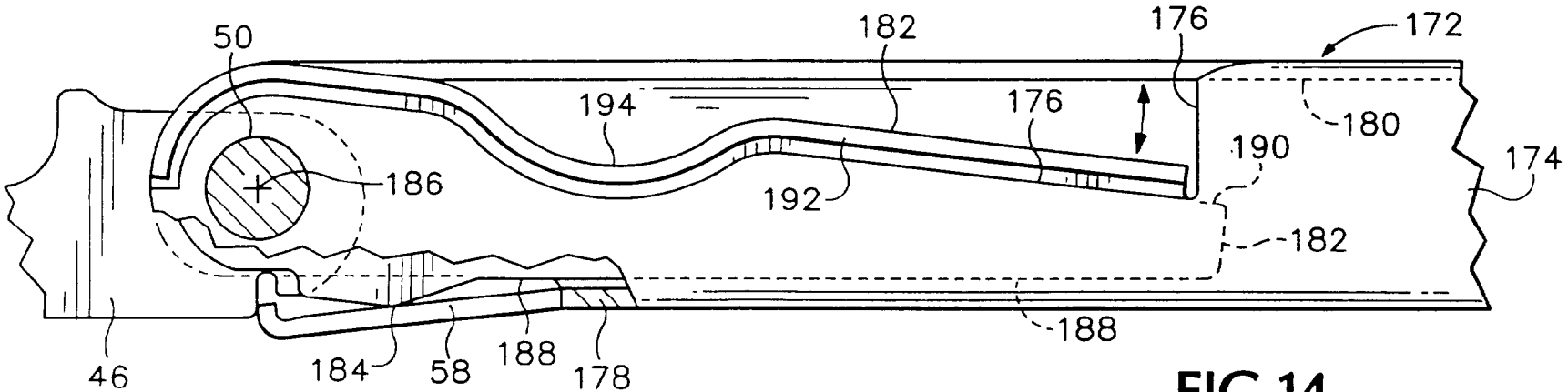
FIG. 14 is a partially cutaway side elevational view of the portions of a tool handle and extended blade shown in FIG.

As shown in FIGS. 13 and 14, in another embodiment of the invention, a handle 172 is also of generally channel-like form, and includes a sidewall 174 defining an opening 176 extending downward from its outer margin toward the back 178. A rim 180, similar to the rim 62, extends along the outer margin of the sidewall 174 apart from the opening 176.

A latch release lever 182 includes a shoulder 184 acting on the latch spring 58, and is mounted for rotation about the pivot pin 50, with an axis of rotation 186 of the latch release lever 182 coinciding with the central axis of the pivot pin 50. The latch release lever 182 has a lower margin 188 that encounters the base or back 178 and prevents the latch release lever 182 from moving downward beyond the position shown in FIG. 14 and from flexing the latch spring 58 beyond its elastic limit.

The upper margin 190 of the free end of the latch release lever 182 engages the rim 180 to limit upward movement of the latch release lever 182 from the position shown in FIG. 14, so that an outwardly directed rim 192 on the latch release lever 182 is aligned with the rim 180 of the sidewall 174 and provides a correspondingly rounded and comfortable shape to be encountered when the handle is gripped in using folding pliers or similar tools associated with a pair of handles such as the handle 172. The rounded rim portion 192 also extends along an indentation 194 that provides convenient access to a nail nick in a folding tool bit or blade such as the screwdriver 46 located adjacent the sidewall 174 and the latch release lever 182.

As may be seen best in FIG. 15, the rims 64 may extend inward to overlap a knife blade 196 or a file 198, requiring the knife 196 or file 198 to be pushed into the respective cavity 70 or 72 before being extended so that removal of one of the other blades or tool bits does not carry the knife 196 or file 198 along unnecessarily.

Handle Folding

In a preferred embodiment of one aspect of the present invention, a pair of pliers jaws 200 shown in FIGS. 15–17 include respective tangs 202, 204 of the jaws, and each tang is attached to a respective one of the handles 42 and 44 by a respective pivot pin 206. The pivot pins 206 are preferably fasteners similar to the pivot pins 50, such as matingly threaded screws and tubular pins, and extend through corresponding holes defined in a pair of opposite flanges 208, 210 in each of the handles 42, 44, located at a second, or jaw pivot end 212 of the tool 40.

The two parts of each pivot pin 206 are tightened together and fixed with a suitable adhesive to hold the flanges 208, 210 alongside each of the tangs 202, 204, but the pivot pins 206 are long enough for the flanges 208, 210 to cause little or no frictional resistance to movement of each tang 202 or 204 with respect to the handle 42 or 44 to which it is attached.

In order to provide a controlled amount of friction resisting movement of the handles 42 and 44 with respect to the tangs 202 and 204, a spring 216 is attached to the channel base 56 inside each of the handles 42, 44 at the jaw pivot end 212. A fastener such as a rivet 218 extends through corresponding apertures in a rear end or inner end 220 of the spring 216 and in the channel base or back 56 of each handle 42 and 44.

An outer end 222 of each spring 216 rests upon a cam 224, which may have a raised arcuate middle portion 226 and a cam lobe 227 leading to an end portion 228. As shown in FIG. 16, the end portions 228 are located at a smaller radial distance from the pivot pins 206 and are relatively flat. The outer ends 222 rest on the cam lobes 227 with a small clearance from the end portions 228 when the handles 42, 44 are extended with respect to the jaws 200. The outer ends 222 of the springs 216 rest on cam lobes 229 adjacent relatively low flattened portions 230 when the handles 42, 44 are folded about the pair of jaws 200 as shown in FIG. 17.

As may be seen in FIG. 18, the spring 216 is a tapered, generally flat spring. Its outer end 222 is bent a few degrees away from the channel base 56 and out of alignment with the inner end 220, and bears upon the tang 202 or 204. The outer end 222 is forked, defining a pair of prongs that have lateral surfaces 232 that face toward each other and are located alongside radial surfaces 234 of a centrally located raised portion or land 236 located alongside the cam 224 on each tang 202 and 204, as shown in FIGS. 19–21. The flat radial surfaces 234 cooperate with the lateral surfaces 232 to keep the outer end 222 of the spring 216 properly aligned with the tangs 202, 204.

It would also be possible to provide the flat radial surfaces on raised portions on opposite sides of the cam 224 on each of the tangs 202, 204 and for the lateral surfaces 232 to be on opposite outer lateral sides of an outer end 222 of a spring 216, which then need not be in the form of a fork.

When the handles 42, 44 are being folded or unfolded with respect to the tangs 202, 204 of the pliers jaws 200, the outer end 222 of the spring 216 rides upon and is elastically biased toward the arcuate surface 226, providing some friction to prevent the handles 42, 44 from moving too easily with respect to the jaws. As the handles 42, 44 approach the fully extended position shown in FIG. 16, the outer ends 222 ride onto the cam lobes 227 and extend toward the flat end portions 228 to urge the handles 42, 44 toward the fully extended position shown in FIG. 16. Similarly, the outer ends 222 ride onto cam lobes 229, providing a small clearance from the flat portions 230 on the opposite side of each tang 202, 204 when the handles 42, 44 approach the fully folded position shown in FIGS. 17 and 21, and by spring force against the cam lobes 229, the springs 216 then urge the handles 42, 44 toward the folded configuration with respect to the tangs 202 and 204 as shown in FIGS. 1 and 17.

When the tool is in the configuration shown in FIG. 16, for use of the pliers jaws 200, an end stop or abutment surface 238 of the channel base 56 or back portion of each handle 42 or 44 rests against a shoulder 240 defined on the confronting side of each of the tangs 202, 204. Consequently, squeezing forces exerted on the handles 42, 44 to close the pliers jaws 200 toward each other are carried through the end stop or abutment surfaces 238 and shoulders 240, and not by the springs 216, so that the rivet 218 needs only enough strength to retain the spring 216 attached to the channel base portion 56 against the elastic force of the spring 216.

While the force of the outer end 222 of the spring 216 against the cam lobe 227 tends to keep the handles extended with respect to the tangs 202, 204, a raised retention bump or interfering body 242 is also provided on the central land 236, close to the shoulder 240, to press against the inner surface of the channel base 56 when the handles 42, 44 are in or nearly in the fully opened configuration shown in FIG. 16. Pressure of the retention bumps 242 against the channel bases 56 provides additional frictional resistance against folding of the handles 42, 44 with respect to the pliers jaws 200. Such resistance is useful, for example, when using wire-cutter portions of the pliers jaws. With the spring 216 acting on the spring cam 224, it is unnecessary to provide interference between the central land 236 and the inner surface of the channel base 56, except when the handles 42, 44 are intended to be more securely held in the open position shown in FIGS. 1A and 16. Nevertheless, there is ample friction provided by the spring 216 to prevent the handles from flopping freely about the tangs 202, 204 of the pliers jaws 200. As a result, it is unnecessary to provide tension in the pivot pin 206 to hold the flanges 208, 210 tightly against the tangs 202, 204, and it is unnecessary to manufacture the tangs 202, 204 with tolerances as demanding as is necessary when the central land 236 or a corresponding surface is required to provide friction against the inside surface of the channel base 56 throughout the entire range of motion of the handles 42, 44 with respect to the pliers jaws 200.

Folding Scissors

As shown in FIGS. 22 and 23, a pair of folding scissors 250 included in the folding multipurpose tool 40 is latched in its operational configuration, extending from the tool blade end 48 of the handle 42. The folding scissors 250 may be made of sheet steel and include a first scissors leg 252, whose base portion 254 is mounted on the pivot pin 50 for rotation between the extended operational position shown in FIG. 22 and a stowed position within the cavity 70 defined between the sidewalls 52 and 54 of the handle 42. A fixed blade portion 256 extends outward from the base portion 254 beyond a blade pivot joint 258 preferably including a rivet extending through corresponding bores in the first scissors leg 252 and a second scissors leg 260 to interconnect the two scissors legs with each other.

The second scissors leg 260 includes a moving blade portion 262 and a handle 264 extending oppositely away from the blade pivot joint 258. A thumb tab 266 extends laterally from an outer end of the handle portion 264 to contribute to comfortable operation of the scissors 250. It may be formed by bending a metal blank from which the second scissors leg 260 is made and, preferably, has an arcuately curved margin to be comfortably pressed.

Each of the blade portions 256 and 262 has a sharp, generally straight smooth edge portion 268, which could be curved, if desired, and which can be used to cut easily through paper with a pushing movement and little movement of those edge portions 268 relative to each other. Additionally, sharpened serrations 270 are provided on each of the blades 256, 262 near the outer end or tip of each blade. The serrations 270 may be in the form of narrow, round bottomed, grooves inclined with respect to the blades, or in the form of continuously wavy or sinuous curves, and may have a depth of 0.003 inch and a radius of curvature of 0.015 inch, for example. The serrations 270 may be spaced apart at a pitch of 0.023 inch, in a preferred embodiment, although variations of these dimensions on the order of a few thousandths of an inch will also be serviceable. Serrations 270 may be provided on either one or both of the blade portions 256 and 262, and the serrations on each blade may be aligned with or staggered with respect to serrations on the opposite blade. Provision of the serrations 270 improves the ability to use the folding scissors 250 to cut materials including small strong fibers, as the serrations 270 can resist tendency of materials being cut to be squeezed outward from between the tips of the blades 256 and 262.

The first scissors leg 252 is held in its extended position with respect to the handle 42 by the engagement of the catch 60 in a notch 272, corresponding with the notch 106 in the base of the folding screwdriver 46 described previously. Alternatively, an outer end of a flat spring (not shown) without a catch 60 could rest on a cam lobe 273 shown in FIG. 26 to hold the first scissors leg in the position shown in FIG. 22.

Pressure on the tab 266 toward the handle 42, when the first scissors leg is in its extended position, pivots the moving blade portion 262 alongside the fixed blade portion 256 for a cutting stroke. In order to reopen the scissors blades from each other after each cutting stroke, a slender finger-like spring 274 extends away from the handle 42 alongside the base portion 254. A tip 276 or outer end of the spring 274 rests against a back surface 278 of the handle 264 when the scissors blades portions 256 and 262 are in a cutting relationship with each other, at least when the pair of scissors 250 is in the operational configuration shown in FIG. 22.

As shown more clearly in FIG. 23, the spring 274 extends from a base 280 defining a central opening fitted on and movable about the pivot shaft 50 alongside the base portion 254 of the first scissors leg 252. The base 280 includes a notch 282 that is aligned with but wider than the notch 272 in the base portion 254 of the first scissors leg 252, so that the base 280 of the spring 274 is free of the catch 60 to rotate about the pivot pin 50 when the folding scissors 250 is in the extended position shown in FIG. 22. The base 280 is able to rotate about the pivot pin 50 together with the first scissors leg 252 when the catch 60 is not engaged in the notch 272 in the base portion 254 of the first scissors leg 252, but the base 280 of the spring 274 is limited to movement through an angle of several degrees, for example, 11 degrees, with respect to the base portion 254 by engagement of a protruding portion such as a pin 284 within an opening such as the hole 286 defined in the base portion 254. The pin 284 may be a separate piece fixedly fitted in a corresponding hole defined in the base 280 of the spring 274, or, preferably, the pin 284 may be produced by coining or semi-piercing the base 280 using suitable punch and die combination.

The pin 284 is located in a leg 288 of the base 280 extending parallel with the spring 274 along the base portion 254 of the first scissors leg 252, and is separated from the spring 274 by a groove leaving room for the finger-like spring 274 to flex along its length and with respect to the base 280 in response to pressure exerted by the back surface 278 of the handle 264. Thus, in use of the scissors 250, when the thumb tab 266 is pressed toward the handle 42, the spring 274 urges the base 280 to rotate counterclockwise as seen in FIG. 23 until the pin 284 engages the interior surface of the hole 286. Further movement of the handle 264 in a clockwise, blade closing direction about the blade pivot joint 258 causes the spring 274 to flex elastically. By reaction, the spring 274 urges the handle 264 in the opposite direction to reopen the moving blade 262 away from the fixed blade portion 256 when pressure on the thumb tab 266 is relaxed. Rotation of the handle 264 with respect to the base portion 254 of the first scissors leg 252 is limited by the leg 288, which blocks the back surface 278 once the edges 268 have closed alongside each other, and thus prevents further movement of the moving blade 262 toward or past the fixed blade portion 256.

When it is desired to stow the scissors 250 in the handle 42 the blade latch release mechanism is operated as described previously to remove the catch 60 from the notches 272 and 282, allowing the base portion 254 of the first scissors leg 252, and the base 280 of the spring 274 to be rotated together about the pivot pin 50 toward the position shown in FIG. 24. The second scissors leg 260 is also rotated counterclockwise as shown in FIG. 23 about the blade pivot joint 258, toward the position shown in FIG. 25 in which the moving blade 262 extends along the base portion 254 of the first scissors leg 252, opposite the direction of the fixed blade portion 256, so that the edges 268 extend substantially oppositely away from the blade pivot joint 258. In order for there to be room for the moving blade 262 to extend alongside the base portion 254, the spring 274 and its base 280 rotate clockwise with respect to the base portion 254 of the first scissors leg 252, until the pin 284 reaches the position in the hole 286 shown in FIG. 25. Further movement of the folding scissors 250 relative to the handle 42 counterclockwise from the position shown in FIG. 25, as by pushing against the base portion 254 and the handle 264, takes the folding scissors 250 the remaining distance into the cavity 70, to the stowed position shown in FIG. 26, in which the spring 274 is free of contact with the back surface 294. Nevertheless, there is room for the spring 274 to rotate counterclockwise slightly with respect to the base portion 254 of the first scissors leg 252 and come into contact with the back surface 294, as a result of the freedom of the pin 284 to move within the hole 286. When the folding scissors 250 are stowed within the cavity 70 the thumb tab 266 lies against the interior surface of the channel base portion 56 leaving room for the jaws 200 of the pliers to be folded into the cavity.

The scissors 250 can be unfolded from the stowed position to prepare them for use by engaging the hook 290 in the base portion 254 of the first scissors leg 252 to rotate it up from the base portion 56 of the handle 42, about the pivot pin 50, until the peripheral surface of the base portion 254 encounters the catch 60. As the first scissors leg 252 is moved further clockwise from the position shown in FIG. 25 toward the position shown in FIG. 23, a peripheral, or outer base surface 292 of the base 280 of the spring 274 also encounters the catch 60, which resists further movement of the base 280 and thus urges it in a counterclockwise direction with respect to the base portion 254 of the first scissors leg 252. This moves the tip 276 of the spring 274 against the back surface 294 of the moving blade 262, which rotates the second scissors leg 260 clockwise about the blade pivot joint 258, bringing the handle 264 toward the base portion 254 of the first scissors leg 252, to make the scissors ready for use once the first scissors leg 252 is fully extended and latched with respect to the handle 42. Until the first scissors leg 252 has been moved from the fully stowed position far enough to provide clearance for the moving blade 262 to swing from the position shown in FIG. 25 to the position shown in FIG. 24, a flat, or clearance, portion 296 of the outer base surface 292 allows the base 280 to rotate about the pivot pin 50 without forcing the outer end 276 against the back surface 294 of the moving blade 262. In order to distribute the pressure of the catch 60 sufficiently to resist undesirable wear, the shape of the outer base surface 292 corresponds closely with the arcuate peripheral surface of the base portion 254, except for the difference between the notch 282 and the notch 272.

Container Opener

One of the folding tool bits of the folding multipurpose tool 40, as shown in FIG. 22, is a combined can opener and bottle opener 300 mounted at the blade pivot end 48 of the handle 44, where its base 302 is mounted on the pivot pin 50, for rotation between a stowed position within the cavity 72 and an extended position, in which the catch 60 on the latch spring 58 of the handle 44 engages a notch 106, as shown in FIGS. 27 and 28. A bore 304 which fits about the pivot pin 50 defines a pivot axis 306 that coincides with the central axis of the pivot pin 50.

The container opener 300 has a generally planar body 308 with opposite sides defining opposite side planes, a right side plane 310 and a left side plane 312, as viewed when using the opener 300. A generally flat back surface 314 is perpendicular to the side planes 310 and 312 and defines a reference plane. Although the back surface 314 need not be precisely planar it does, nevertheless, define generally the location of the reference plane extending perpendicular between the side planes 310 and 312. A nose portion 316 has a front end 318 and is directed forward at a downward angle 319 from the back surface 314 and the corresponding reference plane.

A hook 320 has a tip 322 located in or adjacent the side plane 310. The tip 322 is directed forwardly, generally in line with a bottom margin 324 of the body 308. A surface 323 extends diagonally rearward from the tip 322 toward the right side plane 312, and is seen clearly in FIG. 28. The tip 322 is thus pointed and able to engage a rim of a crown cap easily. A surface 325 parallel with the left side plane 310 is recessed laterally from the side plane 310 and defines a throat space between the tip 322 of the hook 320 and a more rearwardly located portion of the body 308. A rearward surface of the tip portion 322 extends transversely with respect the body 308 and is generally vertical and thus approximately perpendicular to the side plane 310 and the reference plane corresponding to the back surface 314. A sharp edge 326 lies substantially in the side plane 310, aligned with the tip 322, and is defined by a beveled or diagonally extending surface 328 extending obliquely forward from the edge 326 toward the side plane 312. The tip 322 may be spaced rearwardly from the front end 318 by a distance 329 of 0.72 inch in a preferred embodiment of the invention.

The shape of the tip 322 and the location of the throat space enable the tip 322 to extend to the left to be hooked beneath the crimped rim of a "tin" can or similar container whose top is to be removed using the opener 300 so that the rim extends into the throat space while the edge 326 cuts the top of the can. This configuration also enables the opener 300 to have a conveniently small depth 327 of 0.5 inch or less between the back 314 and the bottom 324, to avoid needing excessive space for stowage in the cavity 72 or in another tool handle.

A groove or nail nick 330 may be provided to facilitate raising the opener 300 from a stowage position within the handle 44 to extend it to the position shown in FIG. 22.

A wire stripper 332 in the form of a beveled notch is provided along the bottom 324 and includes a sharpened edge 334.

The opener 300 may be machined from a suitable steel blank, or may be manufactured by metal injection molding and sintering methods, if desired.

As shown in FIGS. 29, 30, and 31, a somewhat similar opener 340 may be manufactured by laminating to one another a pair of layers which may be fine blanked and coined or semi-pierced. A first layer 342, which is the left side when the opener is in use, includes a nose portion 344 on a body 346. A forward lower margin portion 348 of the body 346 faces diagonally downward and forward. A second layer 350, which is the right side when the opener is in use, is located closely alongside the first side layer 342, and the two layers 342 and 350 are aligned with each other by pin-like projections 352 and a bar-like projection 354 on the second side layer 350 which extend into corresponding apertures 356 and 358 defined in the first side layer 342. The projections 352 and 354 may be produced by semi-piercing the second side layer 350 while the openings 356 and 358 may be provided by fine blanking procedures.

At the bottom of the second side layer 350 is a hook 360 extending forward from the body portion 346 of the opener. The hook 360 is bent at an angle of about 15°, for example, to project forward diagonally into the space beneath the first layer 342, ahead of the lower margin 348. The hook 360 and the lower margin 348 cooperatively define a throat space 362 behind the tip of the hook 360, so that the tip of the hook 360 can engage the bottom of the crimped rim of a "tin" can with the rim extending into the throat 362 as the nose portion 344 of the opener 340 is used to pierce and cut away the top member of the container. Since the first side layer 342 has a thickness of only 0.050 inch and has sharp corner edges 364 as a result of being cut from a sheet of steel stock, it performs effectively, if not particularly efficiently, in cutting away the lid of a "tin" can.

A wire stripper 366, similar to the wire stripper 332, may be provided in the lower margin of the left side layer 342.

It will be understood that the openers 300 and 340 could also be made as mirror opposites of the openers described.

Interlocking Blades

In order to stabilize the handles 42, 44 with respect to each other during use of one of the folding blades of the multipurpose folding tool, an interlock portion 370 may be provided on one of the tool bits such as a straight screwdriver 372 stowed within the handle 42, while a mating interlock portion 374 is provided on another folding tool bit such as a cruciform screwdriver 376 stowed within the handle 44 in a position opposite the screwdriver 372. As may be seen in FIGS. 17 and 32, the interlock portions 370 and 374 include respective sloping, inclined surfaces that fit against each other, while face surfaces 378 and 380 that are extensions of the sides of the screwdrivers 372 and 376 extend alongside other tool blades or bits stowed within the opposite handles, so that the relationship between the interlock portions 370 and 374 resists lateral movement of the handles 42 and 44 in respect to each other during use of one of the tool blades or bits stowed ordinarily in either of the handles 42 and 44. Since the interlocks 370 and 374 protrude only a small distance above an imaginary plane defined generally by the rims 62, 64 and the generally coplanar back surfaces of the blades and tools stowed in each of the handles 42 and 44, the interlocks 370 and 374 do not detract noticeably from comfort during use of the pliers jaws 200. They do, however, provide hooks to be engaged by one's fingernail to open a blade or tool bit from its position of storage within a respective one of the handles of a multipurpose tool so that tool bits or blades stowed between other tool bits can be opened easily from the handle in which they are stowed.

It will be understood, as may be seen in FIG. 33, that an additional pair of interlocks 370' and 374' may be provided on another pair of oppositely located tool blades in the handles 42 and 44, so that two pairs of interlocks are available to keep the handles 42 and 44 aligned with each other during use of a selected tool bit or blade including one of the interlocks.

As may be seen with reference to FIGS. 34, 35, 36, 37, and 38, not only may such interlocks be in the form of portions 370 and 374 with inclined mating surfaces and defining hooks, but a respective portion of each tool blade may be machined to a reduced thickness, leaving interlocking flat portions 382 and 384 of reduced thickness able to interlockingly overlap one another as shown in FIGS. 35 and 36. Such overlapping interlocking portions 382 and 384 may each include an almond-shaped opening 385 serving as a nail nick extending through the interlock portion, or overlapping portions 386 and 388 as shown in FIGS. 37 and 38, may be shaped to present a hook to be engaged by one's fingernail to open a particular blade or tool bit from position between other blades or tool bits.

Blade Latch Security

Referring next to FIGS. 4, 39, and 40, a flat surface 400, between the cam lobe 116 and the inner face 110 of the notch 106, in a base 114 of a folding blade or tool bit such as the screwdriver 46, rather than being precisely parallel with the channel base or back surface 56, is inclined outwardly, away from the pivot axis 112 seen in FIG. 4, by an angle 402 which is slightly smaller than the angle 404 by which the inner surface 403 of the latch spring 58 diverges outward from the plane 405 defined by the channel base 56 as a result of deflection of the latch spring 58 by the cam lobe 116. The outwardly inclined orientation of the flat surface 400 relative to a surface parallel with the plane 405 of the channel base 56 gives the notch 106 a slightly, but significantly, deeper surface 110 located opposite the inner face of or in contact with the catch 60 when the inner surface of the latch spring 58 rests on the cam lobe 116. Where the angle 402 is 2°, sloping the flat surface 400 closer to the orientation of the spring 58, while still maintaining an angular divergence of about 1° of arc, gives a depth of engagement of about 0.003 inch, or 6% greater than when the flat surface 400 is parallel with the plane 405. Pressure of the latch spring 58 against the cam lobe 116 still urges the blade, for example, the screwdriver 46, in a counterclockwise direction until the outer face of the catch 60 encounters the shoulder 108 of the blade, as shown in enlarged view in FIG. 39.

Preferably, the notch 106 has a depth 406 beneath the flat surface 400 that is great enough to permit manufacture by use of a blanking die with a radius large enough to have ample strength. This depth 406 will be greater than the depth 408 of the catch 60, which is limited by the ability of the latch spring 58 to flex far enough for the catch 60 to be removed from the notch 106 without exceeding the elastic limit of the latch spring 58.

As shown in FIG. 40, in a multipurpose tool in which the latch spring 58' includes no catch corresponding with the catch 60, the flat surface 400 is inclined outward at an angle 402 with respect to the plane 405 defined by the base portion 56. The flat surface 400 thus diverges slightly, preferably by about 1°, from the orientation of the inner surface of the deflected latch spring 58' that bears on the base 114 of the blade. As a result, the spring 58' presses against the cam lobe 116 and urges the blade in a counterclockwise direction as seen in FIG. 4, keeping the shoulder 108 engaged against the outer end 410 of the latch spring 58', as shown in FIG. 40.

Alternative Handle Configuration

The present invention may also be embodied in a folding multipurpose tool including a handle 412, shown in FIGS. 41–48. Such a tool might be similar to the tool 40 described above and shown in FIG. 1, but would incorporate the handle 412 in place of the handle 44, and a similar, mirror-image handle could be substituted also for the handle 42 of the tool 40 shown in FIG. 1.

The handle 412 has generally the form of an elongate channel with a pair of opposite ends, a blade pivot end 414, and a tool jaw end 416.

Folding blades (not shown) such as the straight screwdriver blade 46 and other screwdriver blades, knife blades, files, and folding scissors may be mounted in the same fashion as in the folding tool 40 at the tool blade end 414 of the handle 412, arranged to pivot about an axis defined by a pivot pin 418 similar to the pivot pin 50 described above. For the sake of simplicity, while the heads of the pivot pin 418 are shown in FIGS. 41, 44, 47, and 48, the pivot pin 418 is omitted from FIGS. 42, 43, 45, and 46.

The handle 412 is of sheet metal blanked and pressed into the form shown, in which a main channel includes a channel base 420 and a pair of sidewalls 422 and 424. The sidewall 422 is connected with the channel base 420 in a smoothly curved bend providing a rounded corner for a comfortable grip. A latch spring 426 extends from the channel base 420 and carries a catch 428.

A latch release mechanism similar to that provided in the tool 40 may be associated with the handle 412, as is shown by the inclusion of a latch release operating lever 430 attached to the sidewall 422 by a fastener such as a rivet 432. The operating lever 430 projects outwardly through an opening 434 defined in the channel base 420 and outer sidewall 422, as seen best in FIGS. 41 and 42.

An inwardly directed rim 436 extends along a margin of the sidewall 422 from the tool blade end 414 toward the jaw pivot end 416, following the contour of the margin of the sidewall 422, including a nail nick access indentation 438. The rim 436 merges with the outer sidewall 422 giving a smoothly rounded surface and additional area to be gripped and squeezed, as described above with respect to the rims 62 and 64.

A hole 440 is provided in the channel base portion 420 of the handle 412 to receive a fastener to attach a spring such as the spring 216 shown in FIG. 15, to act on a tang of a tool such as a pliers jaw.

As in the handle 44 shown in FIG. 15, the sidewalls 422 and 424 include a pair of flanges 442 and 444 at the jaw pivot end 416 of the handle 412, and the flanges 442, 444 define respective openings 446 and 448 to receive a jaw pivot pin 449 shown partially cutaway in FIG. 44. The channel base 420 includes an end surface 450 corresponding with the end surface 238 described above in connection with the tool handle 44.

Interconnected with the sidewall 424 is a side wing portion 452 that initially extends away from the sidewall 424, curving arcuately as shown at 454, and then extends flat and approximately parallel with the sidewall 424, to define a side trough 456 facing in a direction opposite that of the main channel defined between the sidewalls 422 and 424. This aspect of the handle 412 is similar to a portion of the tool described in copending U.S. patent application Ser. No. 08/961,055, of which the disclosure is hereby incorporated herein.

The sidewall 424 is cut to define a blade locking member 458, bent with respect to the sidewall 424 to project at a small angle into the side trough 456, in position for its front surface 459 to engage the base of a folding outer blade 460 shown in its extended position in FIG. 48. A large radially extending axial bearing 461 mounted on the jaw pivot pin 449 keeps the blade 460 attached to the handle 412, supporting it and allowing it to pivot between a folded position shown in FIG. 47 and the extended position shown in FIG. 48. A small detent bump 462 is provided on the blade locking member 458, and an upper surface of the blade locking member 458 defines a notch 464 to receive a projecting member (not shown) associated with the folding outer blade 460, to establish properly the folded position of the outer blade 460, shown in FIG. 47.

A front margin portion 466 of the side wing portion 452 is arcuately curved so as to provide access to push the blade locking member 458. A portion 468 of the margin of the side wing portion 452 is shaped to provide access to a nail nick 470 in the tip of the folding outer blade 460 in order to begin moving it from its folded position in which it is held by interaction of the detent bump 462 with a corresponding dimple (not shown) in the folding outer blade 460.

A bolster 472 is mounted on the handle 412 at the blade pivot end 414, closing the end of the side trough 456 and presenting a smoothly rounded surface having a desirable appearance.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

The invention claimed is:

1. A handle for a folding multipurpose tool of the type having a pair of handles interconnected with each other through a pair of pivotally interconnected members each having a tang pivotally interconnected with one of said handles in such a way that said tool may be arranged in a compact configuration with said members substantially received in said handles or in an extended configuration, said handle comprising:

(a) a channel base;

(b) a pair of opposite channel sidewalls interconnected with said channel base, each of said channel sidewalls having a margin, and said channel base and said sidewalls together defining a channel having a pair of opposite ends; and (c) a narrow rim extending along said margin of at least one of said sidewalls, said rim being directed inwardly toward the respective opposite sidewall along a majority of said margin thereof including at least one of said ends, and said margin of said sidewall including an indentation toward said channel base defining a blade access portion of said sidewall and said inwardly directed narrow rim extending along said indentation, said rim merging with said sidewall in a smoothly curved arcuate surface, said channel facing away from the other one of said pair of handles when said tool is in said extended configuration.

2. A folding tool comprising a handle as defined by claim 1, including a blade attached to said handle at one of said ends and located in a folded position within said channel wherein said channel sidewalls extend along said channel base, said rim extending inwardly over a portion of said blade preventing said blade from being unfolded without first being urged away from said sidewall.

3. The handle of claim 1 wherein at least a part of said margin of each said channel sidewall is arcuately curved proximate said at least one of said opposite ends of said channel.

4. A multipurpose folding tool including a pair of handles interconnected with each other through a pair of pivotally interconnected members each having a tang interconnected with one of said handles in such a way that said tool may be arranged in a compact configuration with said members substantially received in said handles or in an extended configuration, each said handle comprising:

(a) a channel base;

(b) a pair of opposite channel sidewalls interconnected with said channel base, each of said channel sidewalls having a margin, and said channel base and said sidewalls together defining a channel having a pair of opposite ends; and (c) a narrow rim extending along said margin of at least one of said sidewalls, said rim being directed inwardly toward the respective opposite sidewall along a majority of said margin thereof including at least one of said ends, said rim merging with said sidewall in a smoothly curved arcuate surface, said channel facing away from the other one of said pair of handles when said tool is in said extended configuration, said rim extending inwardly over a portion of a blade located in a folded position within said channel, preventing said blade from being unfolded without first being urged away from said sidewall.

5. The multipurpose folding tool of claim 4 wherein in at least one of said pair of handles at least a part of said margin of each said channel sidewall is arcuately curved proximate said at least one of said opposite ends of said channel thereof.

6. A handle for a folding multipurpose tool, comprising:

(a) a channel base;

(b) a pair of opposite channel sidewalls interconnected with said channel base, each of said channel sidewalls having a margin, and said channel base and said sidewalls together defining a channel having a pair of opposite ends;

(c) a narrow rim extending along said margin of at least one of said sidewalls, said rim being directed inwardly toward the respective opposite sidewall along a majority of said margin thereof including at least one of said ends, said rim merging with said sidewall in a smoothly curved arcuate surface; and (d) said margin of said sidewall including an indentation toward said channel base defining a blade access portion of said sidewall, said inwardly directed narrow rim extending along said indentation.

7. A multipurpose folding tool including a pair of handles interconnected with each other through a pair of pivotally interconnected members each having a tang interconnected with one of said handles, one of said handles comprising:

(a) a channel base;

(b) a pair of opposite channel sidewalls interconnected with said channel base, each of said channel sidewalls having a margin, and said channel base and said sidewalls together defining a channel having a pair of opposite ends;

(c) a narrow rim extending along said margin of at least one of said sidewalls, directed inwardly toward the respective opposite sidewall along a majority of said margin thereof including at least one of said ends, said rim merging with said sidewall in a smoothly curved arcuate surface, and (d) said rim extending inwardly over a portion of a blade located in a folded position within said channel, preventing said blade from being unfolded without first being urged away from said sidewall.

8. The multipurpose tool of claim 7 wherein said blade is closely adjacent one of said sidewalls.

* * * * *